US011572752B2

(12) United States Patent
Moellendick et al.

(10) Patent No.: US 11,572,752 B2
(45) Date of Patent: Feb. 7, 2023

(54) DOWNHOLE CABLE DEPLOYMENT

(71) Applicant: Saudi Arabian Oil Company, Dhahran (SA)

(72) Inventors: Timothy E. Moellendick, Dhahran (SA); Amjad Alshaarawi, Khobar (SA); Chinthaka Pasan Gooneratne, Dhahran (SA); Bodong Li, Dhahran (SA); Richard Mark Pye, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 57 days.

(21) Appl. No.: 17/184,232

(22) Filed: Feb. 24, 2021

(65) Prior Publication Data

US 2022/0268117 A1 Aug. 25, 2022

(51) Int. Cl.

| | |
|---|---|
| ***E21B 23/14*** | (2006.01) |
| ***E21B 47/005*** | (2012.01) |
| ***E21B 23/04*** | (2006.01) |

(52) U.S. Cl.

CPC ..... *E21B 23/14* (2013.01); *E21B 23/0415* (2020.05); *E21B 47/005* (2020.05)

(58) Field of Classification Search

CPC ..... E21B 23/14; E21B 23/04; E21B 47/005; E21B 23/0415

See application file for complete search history.

(56) References Cited

U.S. PATENT DOCUMENTS

| | | | |
|---|---|---|---|
| 891,957 | A | 6/1908 | Schubert |
| 2,043,225 | A | 6/1936 | Armentrout et al. |
| 2,110,913 | A | 3/1938 | Lowrey |

(Continued)

FOREIGN PATENT DOCUMENTS

| | | |
|---|---|---|
| CA | 1226325 | 9/1987 |
| CA | 2249432 | 9/2005 |

(Continued)

OTHER PUBLICATIONS

PCT International Search Report and Written Opinion in International Appln. No. PCT/US2022/017708, dated Apr. 11, 2022, 15 pages.

(Continued)

*Primary Examiner* — D. Andrews
(74) *Attorney, Agent, or Firm* — Fish & Richardson P.C.

(57) ABSTRACT

A method of deploying a flexible cable in a wellbore includes carrying, by a tubular assembly, a cable spool cartridge into the wellbore. The cable spool cartridge is attached to an exterior of the tubular assembly and contains the flexible cable. A first end of the flexible cable is attached to a buoyancy device, and the buoyancy device is releasably attached to the cable spool cartridge. A fluid is flowed by the tubular assembly in a downhole direction through an interior of the tubular assembly and in an uphole direction within an annulus at least partially defined by the exterior of the tubular assembly. The fluid has a greater density than the buoyancy device. The buoyancy device is released by the cable spool cartridge, and the buoyancy device is configured to travel after release in the uphole direction with the fluid and thereby pull the flexible cable from the cable spool cartridge and into the annulus.

17 Claims, 10 Drawing Sheets

(56) References Cited

U.S. PATENT DOCUMENTS 2,227,729 A 1/1941 Lynes
2,286,673 A 6/1942 Douglas
2,305,062 A 12/1942 Church et al.
2,344,120 A 3/1944 Baker
2,757,738 A 9/1948 Ritchey
2,509,608 A 5/1950 Penfield
2,688,369 A 9/1954 Broyles
2,690,897 A 10/1954 Clark
2,719,363 A 10/1955 Richard et al.
2,763,314 A 9/1956 Gill
2,795,279 A 6/1957 Erich
2,799,641 A 7/1957 Gordon
2,805,045 A 9/1957 Goodwin
2,822,150 A 2/1958 Muse et al.
2,841,226 A 7/1958 Conrad et al.
2,899,000 A 8/1959 Medders et al.
2,927,775 A 3/1960 Hildebrandt
3,016,244 A 1/1962 Friedrich et al.
3,028,915 A 4/1962 Jennings
3,071,399 A 1/1963 Cronin
3,087,552 A 4/1963 Graham
3,102,599 A 9/1963 Hillburn
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,220,478 A 11/1965 Kinzbach
3,236,307 A 2/1966 Brown
3,253,336 A 5/1966 Brown
3,268,003 A 8/1966 Essary
3,331,439 A 7/1967 Lawrence
3,428,125 A 2/1969 Parker
3,468,373 A 9/1969 Smith
3,522,848 A 8/1970 New
3,547,192 A 12/1970 Claridge et al.
3,547,193 A 12/1970 Gill
3,642,066 A 2/1972 Gill
3,656,564 A 4/1972 Brown
3,696,866 A 10/1972 Dryden
3,839,791 A 10/1974 Feamster
3,862,662 A 1/1975 Kern
3,874,450 A 4/1975 Kern
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,064,211 A 12/1977 Wood
4,084,637 A 4/1978 Todd
4,129,437 A 12/1978 Taguchi et al.
4,135,579 A 1/1979 Rowland et al.
4,140,179 A 2/1979 Kasevich et al.
4,140,180 A 2/1979 Bridges et al.
4,144,935 A 3/1979 Bridges et al.
4,191,493 A 3/1980 Hansson et al.
4,193,448 A 3/1980 Jearnbey
4,193,451 A 3/1980 Dauphine
4,196,329 A 4/1980 Rowland et al.
4,199,025 A 4/1980 Carpenter
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,337,653 A 7/1982 Chauffe
4,343,651 A 8/1982 Yazu et al.
4,354,559 A 10/1982 Johnson
4,373,581 A 2/1983 Toellner
4,394,170 A 7/1983 Sawaoka et al.
4,396,062 A 8/1983 Iskander
4,412,585 A 11/1983 Bouck
4,413,642 A 11/1983 Smith et al.
4,449,585 A 5/1984 Bridges et al.
4,457,365 A 7/1984 Kasevich et al.
4,470,459 A 9/1984 Copland
4,476,926 A 10/1984 Bridges et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,508,168 A 4/1985 Heeren
4,513,815 A 4/1985 Rundell et al.
4,524,826 A 6/1985 Savage
4,524,827 A 6/1985 Bridges et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,636,934 A 1/1987 Schwendemann
RE32,345 E 3/1987 Wood
4,660,636 A 4/1987 Rundell et al.
4,705,108 A 11/1987 Little et al.
4,817,711 A 4/1989 Jearnbey
5,012,863 A 5/1991 Springer
5,018,580 A 5/1991 Skipper
5,037,704 A 8/1991 Nakai et al.
5,055,180 A 10/1991 Klaila
5,068,819 A 11/1991 Misra et al.
5,070,952 A 12/1991 Neff
5,074,355 A 12/1991 Lennon
5,082,054 A 1/1992 Kiamanesh
5,092,056 A 3/1992 Deaton
5,107,705 A 4/1992 Wraight et al.
5,107,931 A 4/1992 Valka et al.
5,228,518 A 7/1993 Wilson et al.
5,236,039 A 8/1993 Edelstein et al.
5,278,550 A 1/1994 Rhein-Knudsen et al.
5,387,776 A 2/1995 Preiser
5,388,648 A 2/1995 Jordan, Jr.
5,490,598 A 2/1996 Adams
5,501,248 A 3/1996 Kiest, Jr.
5,523,158 A 6/1996 Kapoor et al.
5,595,252 A 1/1997 O'Hanlon
5,603,070 A 2/1997 Cerutti et al.
5,690,826 A 11/1997 Cravello
5,803,186 A 9/1998 Berger et al.
5,803,666 A 9/1998 Keller
5,813,480 A 9/1998 Zaleski, Jr. et al.
5,853,049 A 12/1998 Keller
5,890,540 A 4/1999 Pia et al.
5,899,274 A 5/1999 Frauenfeld et al.
5,947,213 A 9/1999 Angle
5,955,666 A 9/1999 Mullins
5,958,236 A 9/1999 Bakula
RE36,362 E 11/1999 Jackson
5,987,385 A 11/1999 Varsamis et al.
6,008,153 A 12/1999 Kukino et al.
6,012,526 A 1/2000 Jennings et al.
6,032,742 A 3/2000 Tomlin et al.
6,041,860 A 3/2000 Nazzal et al.
6,047,239 A 4/2000 Berger et al.
6,096,436 A 8/2000 Inspektor
6,170,531 B1 1/2001 Jung et al.
6,173,795 B1 1/2001 McGarian et al.
6,189,611 B1 2/2001 Kasevich
6,254,844 B1 7/2001 Takeuchi et al.
6,268,726 B1 7/2001 Prammer
6,269,953 B1 8/2001 Seyffert et al.
6,287,079 B1 9/2001 Gosling et al.
6,290,068 B1 9/2001 Adams et al.
6,305,471 B1 10/2001 Milloy
6,325,216 B1 12/2001 Seyffert et al.

(56) References Cited

U.S. PATENT DOCUMENTS 6,328,111 B1 12/2001 Bearden et al.
6,330,913 B1 12/2001 Langseth et al.
6,354,371 B1 3/2002 O'Blanc
6,371,302 B1 4/2002 Adams et al.
6,413,399 B1 7/2002 Kasevich
6,443,228 B1 9/2002 Aronstam
6,454,099 B1 9/2002 Adams et al.
6,469,278 B1 10/2002 Boyce
6,510,947 B1 1/2003 Schulte et al.
6,534,980 B2 2/2003 Toufaily et al.
6,544,411 B2 4/2003 Varandaraj
6,561,269 B1 5/2003 Brown et al.
6,571,877 B1 6/2003 Van Bilderbeek
6,607,080 B2 8/2003 Winkler et al.
6,612,384 B1 9/2003 Singh et al.
6,622,554 B2 9/2003 Manke et al.
6,623,850 B2 9/2003 Kukino et al.
6,629,610 B1 10/2003 Adams et al.
6,637,092 B1 10/2003 Menzel
6,678,616 B1 1/2004 Winkler et al.
6,722,504 B2 4/2004 Schulte et al.
6,741,000 B2 5/2004 Newcomb
6,761,230 B2 7/2004 Cross et al.
6,814,141 B2 11/2004 Huh et al.
6,827,145 B2 12/2004 Fotland et al.
6,845,818 B2 1/2005 Tutuncu et al.
6,847,034 B2 1/2005 Shah et al.
6,850,068 B2 2/2005 Chernali et al.
6,895,678 B2 5/2005 Ash et al.
6,912,177 B2 6/2005 Smith
6,971,265 B1 12/2005 Sheppard et al.
6,993,432 B2 1/2006 Jenkins et al.
7,000,777 B2 2/2006 Adams et al.
7,013,992 B2 3/2006 Tessari et al.
7,048,051 B2 5/2006 McQueen
7,063,155 B2 6/2006 Ruttley
7,086,463 B2 8/2006 Ringgenberg et al.
7,091,460 B2 8/2006 Kinzer
7,109,457 B2 9/2006 Kinzer
7,115,847 B2 10/2006 Kinzer
7,124,819 B2 10/2006 Ciglenec et al.
7,131,498 B2 11/2006 Campo et al.
7,216,767 B2 5/2007 Schulte et al.
7,255,582 B1 8/2007 Liao
7,312,428 B2 12/2007 Kinzer
7,322,776 B2 1/2008 Webb et al.
7,331,385 B2 2/2008 Symington
7,376,514 B2 5/2008 Habashy et al.
7,387,174 B2 6/2008 Lurie
7,445,041 B2 11/2008 O'Brien
7,455,117 B1 11/2008 Hall et al.
7,461,693 B2 12/2008 Considine et al.
7,484,561 B2 2/2009 Bridges
7,539,548 B2 5/2009 Dhawan
7,562,708 B2 7/2009 Cogliandro et al.
7,629,497 B2 12/2009 Pringle
7,631,691 B2 12/2009 Symington et al.
7,647,980 B2 1/2010 Corre et al.
7,650,269 B2 1/2010 Rodney
7,677,673 B2 3/2010 Tranquilla et al.
7,730,625 B2 6/2010 Blake
7,779,903 B2 8/2010 Bailey et al.
7,828,057 B2 11/2010 Kearl et al.
7,909,096 B2 3/2011 Clark et al.
7,951,482 B2 5/2011 Ichinose et al.
7,980,392 B2 7/2011 Varco
8,067,865 B2 11/2011 Savant
8,096,349 B2 1/2012 Considine et al.
8,210,256 B2 7/2012 Bridges et al.
8,237,444 B2 8/2012 Simon
8,245,792 B2 8/2012 Trinh et al.
8,275,549 B2 9/2012 Sabag et al.
8,286,734 B2 10/2012 Hannegan et al.
8,484,858 B2 7/2013 Brannigan et al.
8,511,404 B2 8/2013 Rasheed
8,526,171 B2 9/2013 Wu et al.
8,528,668 B2 9/2013 Rasheed
8,567,491 B2 10/2013 Lurie
8,636,063 B2 1/2014 Ravi et al.
8,678,087 B2 3/2014 Schultz et al.
8,683,859 B2 4/2014 Godager
8,776,609 B2 7/2014 Dria et al.
8,794,062 B2 8/2014 DiFoggio et al.
8,824,240 B2 9/2014 Roberts et al.
8,884,624 B2 11/2014 Homan et al.
8,925,213 B2 1/2015 Sallwasser
8,960,215 B2 2/2015 Cui et al.
8,973,680 B2 3/2015 MacKenzie
9,051,810 B1 6/2015 Cuffe et al.
9,109,429 B2 8/2015 Xu et al.
9,217,291 B2 12/2015 Batarseh
9,217,323 B2 12/2015 Clark
9,222,350 B2 12/2015 Vaughn et al.
9,238,953 B2 1/2016 Fleming et al.
9,238,961 B2 1/2016 Bedouet
9,250,339 B2 2/2016 Ramirez
9,353,589 B2 5/2016 Hekelaar
9,394,782 B2 7/2016 DiGiovanni et al.
9,435,159 B2 9/2016 Scott
9,464,487 B1 10/2016 Zurn
9,470,059 B2 10/2016 Zhou
9,492,885 B2 11/2016 Zediker et al.
9,494,010 B2 11/2016 Flores
9,494,032 B2 11/2016 Roberson et al.
9,528,366 B2 12/2016 Selman et al.
9,562,987 B2 2/2017 Guner et al.
9,567,819 B2 2/2017 Cavender et al.
9,617,815 B2 4/2017 Schwartze et al.
9,664,011 B2 5/2017 Kruspe et al.
9,702,211 B2 7/2017 Tinnen
9,731,471 B2 8/2017 Schaedler et al.
9,739,141 B2 8/2017 Zeng et al.
9,757,796 B2 9/2017 Sherman et al.
9,765,609 B2 9/2017 Chemali et al.
9,845,653 B2 12/2017 Hannegan et al.
9,903,010 B2 2/2018 Doud et al.
9,976,381 B2 5/2018 Martin et al.
10,000,983 B2 6/2018 Jackson et al.
10,113,408 B2 10/2018 Pobedinski et al.
10,174,577 B2 1/2019 Leuchtenberg et al.
10,233,372 B2 3/2019 Ramasamy et al.
10,247,838 B1 * 4/2019 Hveding ..... G02B 6/4407
10,329,877 B2 6/2019 Simpson et al.
10,352,125 B2 7/2019 Frazier
10,392,910 B2 8/2019 Walton et al.
10,394,193 B2 8/2019 Li et al.
10,544,640 B2 1/2020 Hekelaar
10,551,800 B2 2/2020 Li et al.
10,641,079 B2 5/2020 Aljubran et al.
10,673,238 B2 6/2020 Boone et al.
10,927,618 B2 2/2021 Albahrani et al.
11,187,072 B2 * 11/2021 Downey ..... E21B 47/113
2002/0066563 A1 6/2002 Langseth et al.
2003/0052098 A1 3/2003 Kim et al.
2003/0159776 A1 8/2003 Graham
2003/0230526 A1 12/2003 Okabayshi et al.
2004/0163807 A1 * 8/2004 Vercaemer ..... E21B 47/01 166/250.12
2004/0182574 A1 9/2004 Sarmad et al.
2004/0256103 A1 12/2004 Batarseh
2005/0022987 A1 2/2005 Green et al.
2005/0092523 A1 5/2005 McCaskill et al.
2005/0199386 A1 9/2005 Kinzer
2005/0259512 A1 11/2005 Mandal
2006/0016592 A1 1/2006 Wu
2006/0076347 A1 4/2006 Kinzer
2006/0102625 A1 5/2006 Kinzer
2006/0106541 A1 5/2006 Hassan et al.
2006/0144620 A1 7/2006 Cooper
2006/0185843 A1 8/2006 Smith
2006/0248949 A1 11/2006 Gregory et al.
2006/0249307 A1 11/2006 Ritter
2007/0000662 A1 1/2007 Symington et al.
2007/0108202 A1 5/2007 Kinzer

(56) References Cited

U.S. PATENT DOCUMENTS

2007/0131591 A1 6/2007 Pringle
2007/0137852 A1 6/2007 Considine et al.
2007/0137858 A1 6/2007 Considine et al.
2007/0153626 A1 7/2007 Hayes et al.
2007/0175633 A1 8/2007 Kosmala
2007/0181301 A1 8/2007 O'Brien
2007/0187089 A1 8/2007 Bridges
2007/0193744 A1 8/2007 Bridges
2007/0204994 A1 9/2007 Wimmersperg
2007/0261844 A1 11/2007 Cogliandro et al.
2007/0289736 A1 12/2007 Kearl et al.
2008/0007421 A1 1/2008 Liu et al.
2008/0047337 A1 2/2008 Chemali et al.
2008/0053652 A1 3/2008 Corre et al.
2008/0073079 A1 3/2008 Tranquilla et al.
2008/0173443 A1 7/2008 Symington et al.
2008/0173480 A1 7/2008 Annaiyappa et al.
2008/0190822 A1 8/2008 Young
2008/0272931 A1 11/2008 Auzerais et al.
2008/0308282 A1 12/2008 Standridge et al.
2008/0312892 A1 12/2008 Heggemann
2009/0153354 A1 6/2009 Daussin
2009/0164125 A1 6/2009 Bordakov et al.
2009/0178809 A1 7/2009 Jeffryes et al.
2009/0259446 A1 10/2009 Zhang et al.
2009/0288820 A1 11/2009 Barron et al.
2010/0006339 A1 1/2010 Desai
2010/0089583 A1 4/2010 Xu et al.
2010/0186955 A1 7/2010 Saasen et al.
2010/0276209 A1 11/2010 Yong et al.
2010/0282511 A1 11/2010 Maranuk
2011/0011576 A1 1/2011 Cavender et al.
2011/0031026 A1 2/2011 Oxford et al.
2011/0058916 A1 3/2011 Toosky
2011/0120732 A1 5/2011 Lurie
2011/0155368 A1 6/2011 El-Khazindar
2012/0012319 A1 1/2012 Dennis
2012/0075615 A1 3/2012 Niclass et al.
2012/0111578 A1 5/2012 Tverlid
2012/0132418 A1 5/2012 McClung
2012/0132468 A1 5/2012 Scott et al.
2012/0152543 A1 6/2012 Davis
2012/0169841 A1 6/2012 Chemali et al.
2012/0173196 A1 7/2012 Miszewski
2012/0181020 A1 7/2012 Barron et al.
2012/0186817 A1 7/2012 Gibson et al.
2012/0222854 A1 9/2012 McClung, III
2012/0227983 A1 9/2012 Lymberopoulous et al.
2012/0273187 A1 11/2012 Hall
2012/0325564 A1 12/2012 Vaughn et al.
2013/0008653 A1 1/2013 Schultz et al.
2013/0008671 A1 1/2013 Booth
2013/0025943 A1 1/2013 Kumar
2013/0037268 A1 2/2013 Kleefisch et al.
2013/0068525 A1 3/2013 Digiovanni
2013/0076525 A1 3/2013 Vu et al.
2013/0125642 A1 5/2013 Parfitt
2013/0126164 A1 5/2013 Sweatman et al.
2013/0146359 A1 6/2013 Koederitz
2013/0191029 A1 7/2013 Heck, Sr.
2013/0213637 A1 8/2013 Kearl
2013/0255936 A1 10/2013 Statoilydro et al.
2013/0269945 A1 10/2013 Mulholland et al.
2013/0308424 A1 11/2013 Kumar
2014/0034144 A1 2/2014 Cui et al.
2014/0047776 A1 2/2014 Scott et al.
2014/0083771 A1 3/2014 Clark
2014/0090846 A1 4/2014 Deutch
2014/0132468 A1 5/2014 Scott et al.
2014/0183143 A1 7/2014 Cady et al.
2014/0231075 A1 8/2014 Springett et al.
2014/0231147 A1 8/2014 Bozso et al.
2014/0238658 A1 8/2014 Wilson et al.
2014/0246235 A1 9/2014 Yao
2014/0251593 A1 9/2014 Oberg et al.
2014/0251894 A1 9/2014 Larson et al.
2014/0265337 A1 9/2014 Harding et al.
2014/0278111 A1 9/2014 Gerrie et al.
2014/0291023 A1 10/2014 Edbury
2014/0300895 A1 10/2014 Pope et al.
2014/0326506 A1 11/2014 Difoggio
2014/0333754 A1 11/2014 Graves et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.
2015/0027724 A1 1/2015 Symms
2015/0075714 A1 3/2015 Sun et al.
2015/0083422 A1 3/2015 Pritchard
2015/0091737 A1 4/2015 Richardson et al.
2015/0101864 A1 4/2015 May
2015/0129195 A1* 5/2015 Laird ..... E21B 29/005 166/55.8
2015/0129306 A1 5/2015 Coffman et al.
2015/0159467 A1 6/2015 Hartman et al.
2015/0211362 A1 7/2015 Rogers
2015/0267500 A1 9/2015 Van Dogen
2015/0284833 A1 10/2015 Hsiao et al.
2015/0290878 A1 10/2015 Houben et al.
2015/0300151 A1 10/2015 Mohaghegh
2016/0053572 A1 2/2016 Snoswell
2016/0053604 A1 2/2016 Abbassian
2016/0076357 A1 3/2016 Hbaieb
2016/0115783 A1 4/2016 Zeng et al.
2016/0130928 A1 5/2016 Torrione et al.
2016/0153240 A1 6/2016 Braga et al.
2016/0160106 A1 6/2016 Jamison et al.
2016/0237810 A1 8/2016 Beaman et al.
2016/0247316 A1 8/2016 Whalley et al.
2016/0339517 A1 11/2016 Joshi et al.
2016/0356125 A1 12/2016 Bello et al.
2017/0051785 A1 2/2017 Cooper
2017/0077705 A1 3/2017 Kuttel et al.
2017/0161885 A1 6/2017 Parmeshwar et al.
2017/0234104 A1 8/2017 James
2017/0292376 A1 10/2017 Kumar et al.
2017/0314335 A1 11/2017 Kosonde et al.
2017/0328196 A1 11/2017 Shi et al.
2017/0328197 A1 11/2017 Shi et al.
2017/0332482 A1 11/2017 Hauslmann
2017/0342776 A1 11/2017 Bullock et al.
2017/0350201 A1 12/2017 Shi et al.
2017/0350241 A1 12/2017 Shi
2018/0010030 A1 1/2018 Ramasamy et al.
2018/0010419 A1 1/2018 Livescu et al.
2018/0029942 A1 2/2018 Ishida
2018/0171772 A1 6/2018 Rodney
2018/0171774 A1 6/2018 Ringer et al.
2018/0177064 A1 6/2018 Van Pol et al.
2018/0187498 A1 7/2018 Soto et al.
2018/0265416 A1 9/2018 Ishida et al.
2018/0266226 A1 9/2018 Batarseh et al.
2018/0326679 A1 11/2018 Weisenberg et al.
2018/0334883 A1 11/2018 Williamson
2018/0363404 A1 12/2018 Faugstad
2019/0024482 A1* 1/2019 Arora ..... E21B 41/00
2019/0049054 A1 2/2019 Gunnarsson et al.
2019/0101872 A1 4/2019 Li
2019/0145183 A1 5/2019 Potash
2019/0227499 A1 7/2019 Li et al.
2019/0257180 A1 8/2019 Kriesels et al.
2019/0267805 A1 8/2019 Kothuru et al.
2020/0032638 A1 1/2020 Ezzeddine
2020/0125040 A1 4/2020 Li et al.
2020/0182043 A1 6/2020 Downey et al.
2020/0240258 A1 7/2020 Stokely et al.
2020/0248546 A1 8/2020 Torrione et al.
2020/0370381 A1 11/2020 Al-Rubaii et al.
2020/0371495 A1 11/2020 Al-Rubaii et al.
2021/0032934 A1 2/2021 Zhan et al.
2021/0032935 A1 2/2021 Zhan et al.
2021/0032936 A1 2/2021 Zhan et al.

(56) References Cited

U.S. PATENT DOCUMENTS

| | | | |
|---|---|---|---|
| 2021/0034029 | A1 | 2/2021 | Zhan et al. |
| 2021/0189830 | A1* | 6/2021 | Greci ..... E21B 43/103 |

FOREIGN PATENT DOCUMENTS

| | | |
|---|---|---|
| CA | 2537585 | 8/2006 |
| CA | 2669721 | 7/2011 |
| CA | 2594042 | 8/2012 |
| CA | 3007884 | 7/2017 |
| CN | 101079591 | 11/2007 |
| CN | 200989202 | 12/2007 |
| CN | 102493813 | 6/2012 |
| CN | 203232293 | 10/2013 |
| CN | 104295448 | 1/2015 |
| CN | 204627586 | 9/2015 |
| CN | 106119763 | 11/2016 |
| CN | 107462222 | 12/2017 |
| CN | 109437920 | 3/2019 |
| CN | 110571475 | 12/2019 |
| DE | 102008001607 | 11/2009 |
| DE | 102011008809 | 7/2012 |
| DE | 102012022453 | 5/2014 |
| DE | 102013200450 | 7/2014 |
| DE | 102012205757 | 8/2014 |
| EP | 2317068 | 5/2011 |
| EP | 2574722 | 4/2013 |
| EP | 2737173 | 6/2014 |
| EP | 3333141 | 6/2018 |
| FR | 3051699 | 12/2017 |
| GB | 2124855 | 2/1984 |
| GB | 2357305 | 6/2001 |
| GB | 2399515 | 9/2004 |
| GB | 2422125 | 7/2006 |
| GB | 2532967 | 6/2016 |
| JP | 2009067609 | 4/2009 |
| JP | 4275896 | 6/2009 |
| JP | 5013156 | 8/2012 |
| JP | 2013110910 | 6/2013 |
| NO | 343139 | 11/2018 |
| NO | 20161842 | 5/2019 |
| RU | 2282708 | 8/2006 |
| RU | 122531 | 11/2012 |
| WO | WO 1995035429 | 12/1995 |
| WO | WO 1997021904 | 6/1997 |
| WO | WO 2000025942 | 5/2000 |
| WO | WO 2000031374 | 6/2000 |
| WO | WO 2001042622 | 6/2001 |
| WO | WO 2002020944 | 3/2002 |
| WO | WO 2002068793 | 9/2002 |
| WO | WO 2004042185 | 5/2004 |
| WO | WO 2007049026 | 5/2007 |
| WO | WO 2007070305 | 6/2007 |
| WO | WO 2008146017 | 12/2008 |
| WO | WO 2009020889 | 2/2009 |
| WO | WO 2009113895 | 9/2009 |
| WO | WO 2010054353 | 5/2010 |
| WO | WO 2010105177 | 9/2010 |
| WO | WO 2011038170 | 3/2011 |
| WO | WO 2011042622 | 6/2011 |
| WO | WO 2011130159 | 10/2011 |
| WO | WO 201113 9697 | 11/2011 |
| WO | WO 2012007407 | 1/2012 |
| WO | WO 2013016095 | 1/2013 |
| WO | WO 2013148510 | 10/2013 |
| WO | WO 201412703 5 | 8/2014 |
| WO | WO 2015072971 | 5/2015 |
| WO | WO 2015095155 | 6/2015 |
| WO | WO 2016178005 | 11/2016 |
| WO | WO 2017011078 | 1/2017 |
| WO | WO 2017027105 | 2/2017 |
| WO | WO 2017132297 | 8/2017 |
| WO | WO 2017196303 | 11/2017 |
| WO | WO 2018022198 | 2/2018 |
| WO | WO 2018046361 | 3/2018 |
| WO | WO 2018167022 | 9/2018 |
| WO | WO 2018169991 | 9/2018 |
| WO | WO 2019040091 | 2/2019 |
| WO | WO 2019055240 | 3/2019 |
| WO | WO 2019089926 | 5/2019 |
| WO | WO 2019108931 | 6/2019 |
| WO | WO 2019125493 | 6/2019 |
| WO | WO 2019169067 | 9/2019 |
| WO | WO 2019236288 | 12/2019 |
| WO | WO 2019246263 | 12/2019 |

OTHER PUBLICATIONS

U.S. Appl. No. 16/524,935, filed Jul. 29, 2019, Zhan et al.

"IADC Dull Grading for PDC Drill Bits," Beste Bit, SPE/IADC 23939, 1992, 52 pages.

AkerSolutions, "Aker MH CCTC Improving Safety," AkerSolutions, Jan. 2008, 12 pages.

Anwar et al., "Fog computing: an overview of big IoT data analytics," ID 7157192, Wiley, Hindawi, Wireless communications and mobile computing, May 2018, 2018: 1-22, 23 pages.

Artymiuk et al., "The new drilling control and monitoring system," Acta Montanistica Slovaca, Sep. 2004, 9:3 (145-151), 7 pages.

Ashby et al., "Coiled Tubing Conveyed Video Camera and Multi-Arm Caliper Liner Damage Diagnostics Post Plug and Perf Frac," SPE-172622-MS, Society of Petroleum Engineers (SPE), presented at the SPE Middle East Oil & Gas Show and Conference, Mar. 8-11, 2015, 12 pages.

Bilal et al., "Potentials, trends, and prospects in edge technologies: Fog, cloudlet, mobile edge, and micro data centers," Computer Networks, Elsevier, Oct. 2017, 130: 94-120, 27 pages.

Carpenter, "Advancing Deepwater Kick Detection," JPT, 68:5, May 2016, 2 pages.

Caryotakis, "The klystron: A microwave source of surprising range and endurance." The American Physical Society, Division of Plasma Physics Conference in Pittsburg, PA, Nov. 1997, 14 pages.

Commer et al., "New advances in three-dimensional controlled-source electromagnetic inversion," Geophys. J. Int., 2008, 172: 513-535, 23 pages.

Corona et al., "Novel Washpipe-Free ICD Completion With Dissolvable Material," OTC-28863-MS, presented at the Offshore Technology Conference, Houston, TX, Apr. 30-May 3, 2018, 2018, OTC, 10 pages.

Dickens et al., "An LED array-based light induced fluorescence sensor for real-time process and field monitoring," Sensors and Actuators B: Chemical, Elsevier, Apr. 2011, 158:1 (35-42), 8 pages.

Dong et al., "Dual Substitution and Spark Plasma Sintering to Improve Ionic Conductivity of Garnet Li7La3Zr2O12," Nanomaterials, 9:721, 2019, 10 pages.

downholediagnostic.com [online] "Acoustic Fluid Level Surveys," retrieved from URL <https://www.downholediagnostic.com/fluid-level> retrieved on Mar. 27, 2020, available on or before 2018, 13 pages.

edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.

Fjetland et al., "Kick Detection and Influx Size Estimation during Offshore Drilling Operations using Deep Learning," INSPEC 18992956, IEEE, presented at the 2019 14th IEEE Conference on Industrial Electronics and Applications (ICIEA), Jun. 19-21, 2019, 6 pages.

Gemmeke and Ruiter, "3D ultrasound computer tomography for medical imagining," Nuclear Instruments and Methods in Physics Research Section A:580 (1057-1065), Oct. 1, 2007, 9 pages.

gryphonoilfield.com [online], "Gryphon Oilfield Services, Echo Dissolvable Fracturing Plug," available on or before Jun. 17, 2020, retrieved on Aug. 20, 2020, retrieved from URL <https://www.gryphonoilfield.com/wp-content/uploads/2018/09/Echo-Series-Dissolvable-Fracturing-Plugs-8-23-2018-1.pdf>, 1 page.

halliburton.com [online], "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, 2014, 64 pages.

(56) References Cited

OTHER PUBLICATIONS

Hopkin, "Factor Affecting Cuttings Removal during Rotary Drilling," Journal of Petroleum Technology 19.06, Jun. 1967, 8 pages.
Ji et al., "Submicron Sized Nb Doped Lithium Garnet for High Ionic Conductivity Solid Electrolyte and Performance of All Solid-State Lithium Battery," doi:10.20944/preprints201912.0307.v1, Dec. 2019, 10 pages.
Johnson et al., "Advanced Deepwater Kick Detection," IADC/SPE 167990, presented at the 2014 IADC/SPE Drilling Conference and Exhibition, Mar. 4-6, 2014, 10 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
King et al., "Atomic layer deposition of TiO2 films on particles in a fluidized bed reactor," Power Technology, 183:3, Apr. 2008, 8 pages.
Lafond et al., "Automated Influx and Loss Detection System Based on Advanced Mud Flow Modeling," SPE-195835-MS, Society of Petroleum Engineers (SPE), presented at the SPE Annual Technical Conference and Exhibition, Sep. 30-Oct. 2, 2019, 11 pages.
Li et al., 3D Printed Hybrid Electrodes for Lithium-ion Batteries, Missouri University of Science and Technology, Washington State University; ECS Transactions, 77 (11) 1209-1218 (2017), 11 pages.
Liu et al., "Flow visualization and measurement in flow field of a torque converter," Mechanic automation and control Engineering, Second International Conference on IEEE, Jul. 15, 2011, 1329-1331.
Liu et al., "Superstrong micro-grained polycrystalline diamond compact through work hardening under high pressure," Appl. Phys. Lett. Feb. 2018, 112: 6 pages.
Liu, et al. "Hardness of Polycrystalline Wurtsite Boron Nitride (wBN) Compacts," Scientific Reports, Jul. 2019, 9(1):1-6, 6 pages.
Luo et al., "Simple Charts to Determine Hole Cleaning Requirements in Deviated Wells," IADC/SPE 27486, SPE/IADC Drilling Conference, Society of Petroleum Engineers, Feb. 15-18, 1994, 7 pages.
Maurer, "The Perfect Cleaning Theory of Rotary Drilling," Journal of Petroleum Technology 14.11, 1962, 5 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.
Nuth, "Smart oil field distributed computing," The Industrial Ethernet Book, Nov. 2014, 85:14 (1-3), 3 pages.
Olver, "Compact Antenna Test Ranges," Seventh International Conference on Antennas and Propagation IEEE, Apr. 15-18, 1991, 10 pages.
Paiaman et al., "Effect of Drilling Fluid Properties on Rate Penetration," Nafta 60:3, 2009, 6 pages.
Parini et al., "Chapter 3: Antenna measurements," in Theory and Practice of Modern Antenna Range Measurements, IET editorial, 2014, 30 pages.
petrowiki.org [online], "Hole Cleaning," retrieved from URL <http://petrowiki.org/Hole_cleaning#Annular-fluid_velocity>, retrieved on Jan. 25, 2019, 8 pages.
petrowiki.org [online], "Kicks," Petrowiki, available on or before Jun. 26, 2015, retrieved on Jan. 24, 2018, retrieved from URL <https://petrowiki.org/Kicks>, 6 pages.
Ranjbar, "Cutting Transport in Inclined and Horizontal Wellbore," University of Stavanger, Faculty of Science and Technology, Master's Thesis, Jul. 6, 2010, 137 pages.
Rasi, "Hole Cleaning in Large, High-Angle Wellbores," IADC/SPE 27464, Society of Petroleum Engineers (SPE), presented at the 1994 SPE/IADC Drilling Conference, Feb. 15-18, 1994, 12 pages.
rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Robinson and Morgan, "Effect of Hole Cleaning on Drilling Rate Performance," Paper Aade-04-Df-Ho-42, AADE 2004 Drilling Fluids Conference, Houston, Texas, Apr. 6-7, 2004, 7 pages.
Robinson, "Economic Consequences of Poor Solids and Control," AADE 2006 Fluids Conference and Houston, Texas, Apr. 11-12, 2006, 9 pages.
Rubaii et al., "A new robust approach for hole cleaning to improve rate of penetration," SPE 192223-MS, Society of Petroleum Engineers (SPE), presented at the SPE Kingdom of Saudi Arabia Annual Technical Symposium and Exhibition, Apr. 23-26, 2018, 40 pages.
Ruiter et al., "3D ultrasound computer tomography of the breast: A new era?" European Journal of Radiology 81S1, Sep. 2012, 2 pages.
sageoiltools.com [online] "Fluid Level & Dynamometer Instruments for Analysis due Optimization of Oil and Gas Wells," retrieved from URL <http://www.sageoiltools.com/>, retrieved on Mar. 27, 2020, available on or before 2019, 3 pages.
Schlumberger, "CERTIS: Retrievable, single-trip, production-level isolation system," www.slb.com/CERTIS, 2017, 2 pages.
Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.
Schlumberger, "The Lifting Business," Offshore Engineer, Mar. 2017, 1 page.
Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
Sifferman et al., "Drilling cutting transport in full scale vertical annuli," Journal of Petroleum Technology 26.11, 48th Annual Fall Meeting of the Society of Petroleum Engineers of AIME, Las Vegas, Sep. 30-Oct. 3, 1973, 12 pages.
slb.com [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retrieved on Nov. 2, 2018, 1 pages.
slb.com [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
Sulzer Metco, "An Introduction to Thermal Spray," 4, 2013, 24 pages.
Takahashi et al., "Degradation study on materials for dissolvable frac plugs," URTeC 2901283, presented at the Unconventional Resources Technology Conference, Houston, Texas, Jul. 23-25, 2018, 9 pages.
tervesinc.com [online], "Tervalloy™ Degradable Magnesium Alloys," available on or before Jun. 12, 2016, via Internet Archive: Wayback Machine URL <https://web.archive.org/web/20160612114602/http://tervesinc.com/media/Terves_8-Pg_Brochure.pd>, retrieved on Aug. 20, 2020, <http://tervesinc.com/media/Terves_8-Pg_Brochure.pdf>, 8 pages.
Tobenna, "Hole Cleaning Hydraulics," Universitetet o Stavanger, Faculty of Science and Technology, Master's Thesis, Jun. 15, 2010, 75 pages.
Utkin et al., "Shock Compressibility and Spallation Strength of Cubic Modification of Polycrystalline Boron Nitride," High Temperature, 2009, 47(5):628-634, 7 pages.
Wastu et al., "The effect of drilling mud on hole cleaning in oil and gas industry," Journal of Physics: Conference Series, Dec. 2019, 1402:2, 7 pages.
Weatherford, "RFID Advanced Reservoir Management System Optimizes Injection Well Design, Improves Reservoir Management," Weatherford.com, 2013, 2 pages.

(56) References Cited

OTHER PUBLICATIONS

Wei et al., "The Fabrication of All-Solid-State Lithium-Ion Batteries via Spark Plasma Sintering," Metals, 7: 372, 2017, 9 pages.
Wellbore Service Tools: Retrievable tools, "RTTS Packer," Halliburton: Completion Tools, 2017, 4 pages.
wikipedia.org [online] "Optical Flowmeters," retrieved from URL <https://en.wikipedia.org/wiki/Flow_measurement#Optical_flowmeters>, retrieved on Mar. 27, 2020, available on or before Jan. 2020, 1 page.
wikipedia.org [online] "Ultrasonic Flow Meter," retrieved from URL <https://en.wikipedia.org/wiki/Ultrasonic_flow_meter>, retrieved on Mar. 27, 2020, available on or before Sep. 2019, 3 pages.
wikipedia.org [online], "Atomic layer deposition," available on or before Sep. 10, 2014, via Internet Archive: Wayback Machine URL <http://web.archive.org/web/20140910101023/http://en.wikipedia.org/wiki/Atomic_layer_deposition>, retrieved on Feb. 9, 2021, <https://en.wikipedia.org/wiki/Atomic_layer_deposition>.
wikipedia.org [online], "Chemical vapor deposition," available on or before Apr. 11, 2013, via Internet Archive: Wayback Machine URL <http://web.archive.org/web/20130411025512/http://en.wikipedia.org:80/wiki/Chemical_Vapor_Deposition>, retrieved on Feb. 9, 2021, URL <https://en.wikipedia.org/wiki/Chemical_vapor_deposition>, 12 pages.
wikipedia.org [online], "Surface roughness," retrieved from URL <https://en.wikipedia.org/wiki/Surface_roughness>, retrieved on Apr. 2, 2020, available on or before Oct. 2017, 6 pages.
Williams and Bruce, "Carrying Capacity of Drilling Muds," Journal of Petroleum Technology, 3.04, 192, 1951, 10 pages.
Xia et al., "A Cutting Concentration Model of a Vertical Wellbore Annulus in Deep-water Drilling Operation and its Application," Applied Mechanics and Materials, 101-102, Sep. 27, 2011, 5 pages.
Xue et al., "Spark plasma sintering plus heat-treatment of Ta-doped Li7La3Zr2O12 solid electrolyte and its ionic conductivity," Mater. Res. Express 7 (2020) 025518, 8 pages.
Zhan et al. "Effect of β-to-α Phase Transformation on the Microstructural Development and Mechanical Properties of Fine-Grained Silicon Carbide Ceramics," Journal of the American Ceramic Society 84.5, May 2001, 6 pages.
Zhan et al. "Single-wall carbon nanotubes as attractive toughening agents in alumina-based nanocomposites," Nature Materials 2.1, Jan. 2003, 6 pages.
Zhan et al., "Atomic Layer Deposition on Bulk Quantities of Surfactant Modified Single-Walled Carbon Nanotubes," Journal of American Ceramic Society, 91:3, Mar. 2008, 5 pages.
Zhang et al, "Increasing Polypropylene High Temperature Stability by Blending Polypropylene-Bonded Hindered Phenol Antioxidant," Macromolecules, 51:5 (1927-1936), 2018, 10 pages.
Zhu et al., "Spark Plasma Sintering of Lithium Aluminum Germanium Phosphate Solid Electrolyte and its Electrochemical Properties," University of British Columbia; Nanomaterials, 9, 1086, 2019, 10 pages.

* cited by examiner

DOWNHOLE CABLE DEPLOYMENT

TECHNICAL FIELD

This disclosure relates to wellbore drilling and completion.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include a series of casings or liners cemented in the wellbore to help control the well and maintain well integrity.

Flexible cables such as fiber optic cables or electric cables are used for various downhole sensing, power, and/or data transmission purposes.

SUMMARY

This disclosure describes a system and method for deploying a flexible cable in a downhole conduit.

Certain aspects of the subject matter herein can be implemented as a method of deploying a flexible cable in a wellbore. The method includes carrying, by a tubular assembly, a cable spool cartridge into the wellbore. The cable spool cartridge is attached to an exterior of the tubular assembly and contains the flexible cable. A first end of the flexible cable is attached to a buoyancy device, and the buoyancy device is releasably attached to the cable spool cartridge. A fluid is flowed by the tubular assembly in a downhole direction through an interior of the tubular assembly and in an uphole direction within an annulus at least partially defined by the exterior of the tubular assembly. The fluid has a greater density than the buoyancy device. The buoyancy device is released by the cable spool cartridge, and the buoyancy device is configured to travel after release in the uphole direction with the fluid and thereby pull the flexible cable from the cable spool cartridge and into the annulus.

An aspect combinable with any of the other aspects can include the following features. The flexible cable comprises a fiber optic cable. A light signal is transmitted through the fiber optic cable.

An aspect combinable with any of the other aspects can include the following features. The fluid comprises a cement slurry. A position of the cement slurry in the annulus is detected based on a signal from the flexible cable.

An aspect combinable with any of the other aspects can include the following features. A change in a mechanical property of cement in the annulus is detected based on a signal from the flexible cable.

An aspect combinable with any of the other aspects can include the following features. The mechanical property is a strain load.

An aspect combinable with any of the other aspects can include the following features. The flexible cable comprises an electric cable. A change in an electrical resistance of cement in the annulus is detected.

An aspect combinable with any of the other aspects can include the following features. The cable spool cartridge includes a plurality of flexible cables. Each of the flexible cables has a respective first end attached to the buoyancy device.

An aspect combinable with any of the other aspects can include the following features. A first casing has been installed in the wellbore. The tubular assembly includes a second casing. The annulus is defined by the interior of the first casing and the exterior of the second casing.

An aspect combinable with any of the other aspects can include the following features. A second cable spool cartridge is attached to an exterior of a third casing. The second cable spool cartridge contains a second flexible cable, and a first end of the second flexible cable is attached to a second buoyancy device releasably attached to the second cable spool cartridge. The third casing assembly is lowered into the wellbore within the second casing, and the second cable spool cartridge is positioned proximate to the downhole end of the third casing within a second annulus defined by the interior of the second casing and the exterior of the third casing. A fluid is flowed in an uphole direction in the second annulus, the fluid having a greater density than the second buoyancy device. The second buoyancy device is released from the second cable spool cartridge, thereby allowing the first end of the second flexible cable to travel in an uphole direction with the fluid and thereby pull the second flexible cable from the second cable spool cartridge and into the second annulus.

An aspect combinable with any of the other aspects can include the following features. The first end of the flexible cable and the first end of the second flexible cable are attached to a data acquisition unit.

An aspect combinable with any of the other aspects can include the following features. The flexible cable comprises a power cable.

Certain aspects of the subject matter herein can be implemented as a downhole deployment system for a flexible cable. The system includes a cable spool cartridge configured to be attached to an exterior of a wellbore assembly at a downhole location. The cable spool cartridge contains the flexible cable. A buoyancy device is releasably attached to a first end of the flexible cable and releasably attached to the cable spool cartridge. The buoyancy device is configured to be released from the cable spool cartridge to travel in an upwards direction within a conduit at least partially filled with a fluid having a higher density than the buoyancy device, thereby pulling the flexible cable from the cable spool cartridge and into the conduit.

An aspect combinable with any of the other aspects can include the following features. The flexible cable comprises a fiber optic cable.

An aspect combinable with any of the other aspects can include the following features. The flexible cable comprises an electric cable.

An aspect combinable with any of the other aspects can include the following features. The fluid comprises a cement slurry.

An aspect combinable with any of the other aspects can include the following features. The wellbore assembly comprises a second casing within a first casing, and the conduit comprises an annulus defined by the interior of the first casing and the exterior of the second casing.

An aspect combinable with any of the other aspects can include the following features. The system includes a shear pin configured to release the buoyancy device in response to plug landing in a plug seat.

An aspect combinable with any of the other aspects can include the following features. The system includes an electronic control unit configured to release the buoyancy device in response to a signal from a circuit closing in response to pumpable plug landing in a downhole plug seat, a signal generated by a sensor configured to sense an arrival of a pumpable plug at a downhole location, or a signal from an operator.

An aspect combinable with any of the other aspects can include the following features. A data acquisition unit attachable to an end of the flexible cable.

An aspect combinable with any of the other aspects can include the following features. The data acquisition unit is a laser box.

An aspect combinable with any of the other aspects can include the following features. The cable spool cartridge includes a plurality of flexible cables, each of the plurality of flexible cables having a respective first end, and wherein each respective first end of the plurality of flexible cables is attached to the buoyancy device.

An aspect combinable with any of the other aspects can include the following features. The flexible cable comprises a power cable.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes a system, tool, and method for deploying a downhole flexible cable.

Downhole flexible cables such as fiber optic cables or electric cables are used for various downhole sensing and/or data transmission purposes. For example, it may be advantageous to deploy a fiber optic cable within the cement sheath along the vertical length of the cemented annular space in between two casing strings, called the casing-casing annulus. Such a fiber optic cable can be deployed in the casing-casing annulus during cementing operations to, for example, measure the height of the cement slurry as it exits the casing shoe and advances towards the surface within the annulus.

Alternatively or in addition, a fiber optic cable installed in the casing-casing annulus after cement placement can be used to detect the change in mechanical properties of the cement as the cement dehydrates and hardens.

Alternatively or in addition, a fiber optic cable installed in the casing-casing annulus can be used to measure strain or other properties throughout the life of the well, thus detecting pressure-induced events and/or any cracks or other failures in the cement sheath.

The system, tool, and method of the present disclosure can efficiently deploy a fiber optic cable or other cable in a casing-casing annulus or other conduit with a low risk of cable breakage or other damage, thus resulting in more efficient and effective detection and monitoring of the cement sheath or other downhole conditions with a low risk of failure. Furthermore, in some embodiments, the system, tool, and method of the present disclosure can efficiently deploy multiple cables in parallel in an annulus or other conduit, thus enabling redundancy and/or multiple sensing modes in the same conduit.

Figure 1:
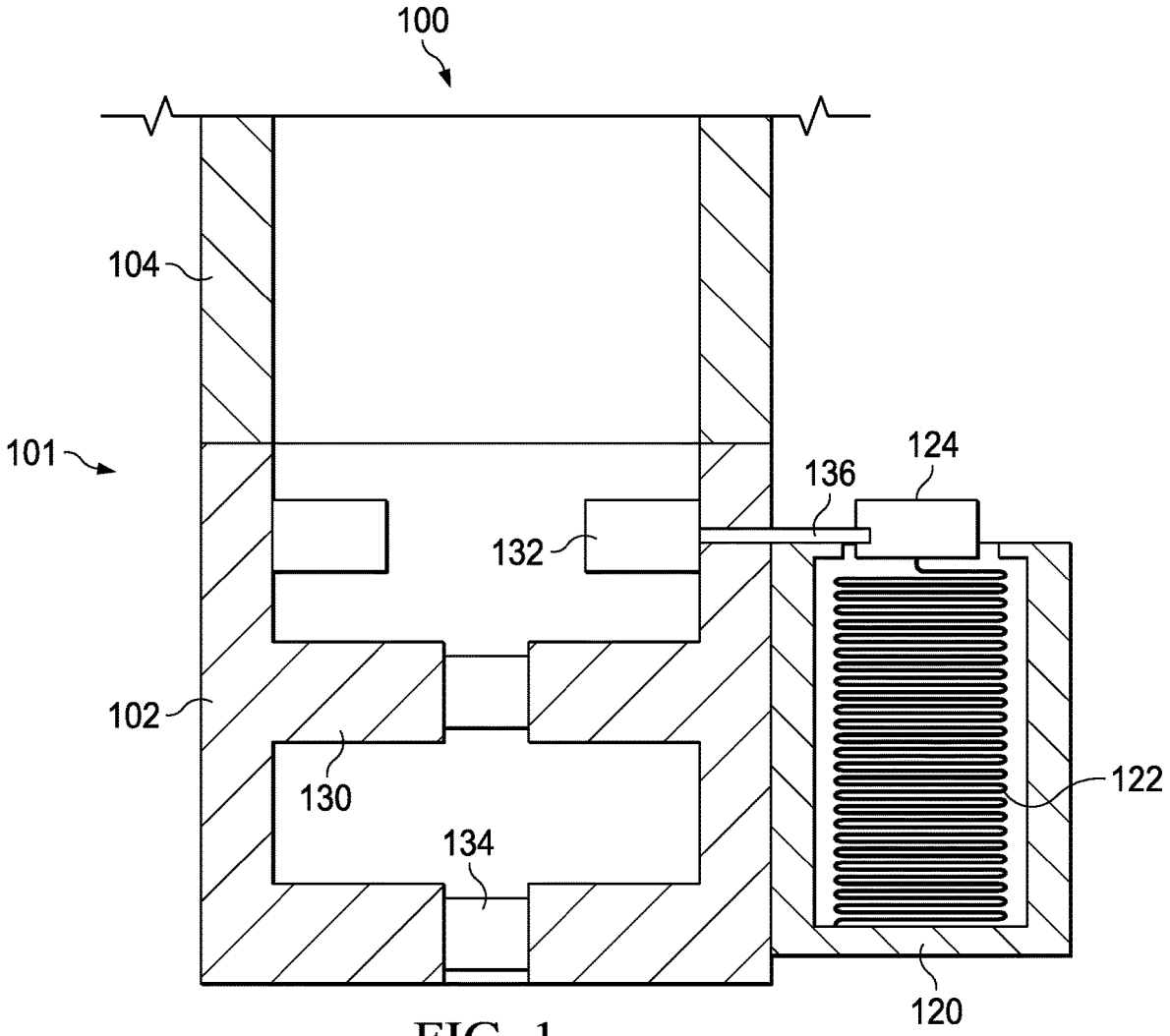
FIG. 1 is a drawing of an example cable deployment system in accordance with an embodiment of the present disclosure.

FIG. 1 illustrates a cable deployment system 100 in accordance with an embodiment of the present disclosure. In the illustrated embodiment, cable deployment system 100 includes a tubular assembly 101 which includes casing shoe track 102 and casing string 104. Casing shoe track 102 is attached to the downhole end of casing string 104. In some embodiments, tubular assembly 101 can include more, fewer, or different components.

Cable spool cartridge 120 is attached to an exterior surface of casing shoe track 102. Cable spool cartridge 120 includes a cable 122 spooled inside of a housing and buoyancy device 124 attached to a first end of cable 122. In some embodiments, cable 122 can be a fiber optic cable or other sensor cable. In some embodiments, cable 122 can be an electric cable or other power cable. The second end of cable 122 is attached to cable spool cartridge 120 and the remaining length of cable 122 is spooled within cable spool cartridge 120.

In the embodiment shown in FIG. 1, casing shoe track 102 includes a float collar 130, plug seat 132, and float shoe 134. In the illustrated embodiment, and as described in more detail with respect to FIG. 2 and FIGS. 3A-3D, system 100 is configured such that landing a plug in plug seat 132 will break shear pin 136, which thereby releases buoyancy device 124 from cartridge 120.

Figure 2:
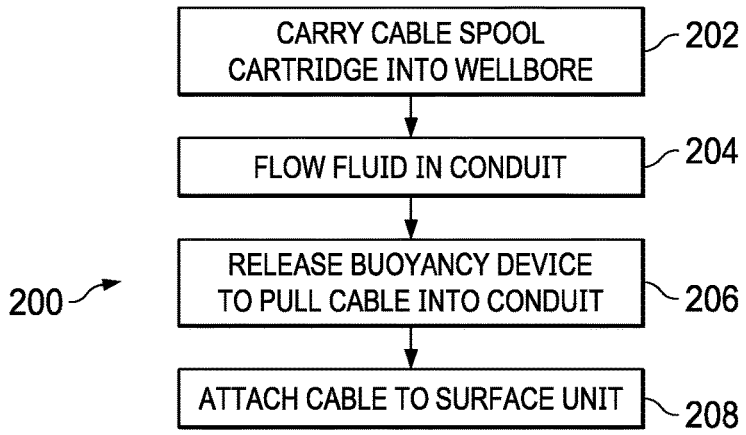
FIG. 2 is a process flow diagram of a method for deployment of a cable accordance with an embodiment of the present disclosure.

FIG. 2 is a process flow diagram of a method 200 for deployment of a flexible cable in accordance with an embodiment of the present disclosure. The method is described with reference to the components described in reference to FIGS. 1 and 3A-3D.

Figure 3A:
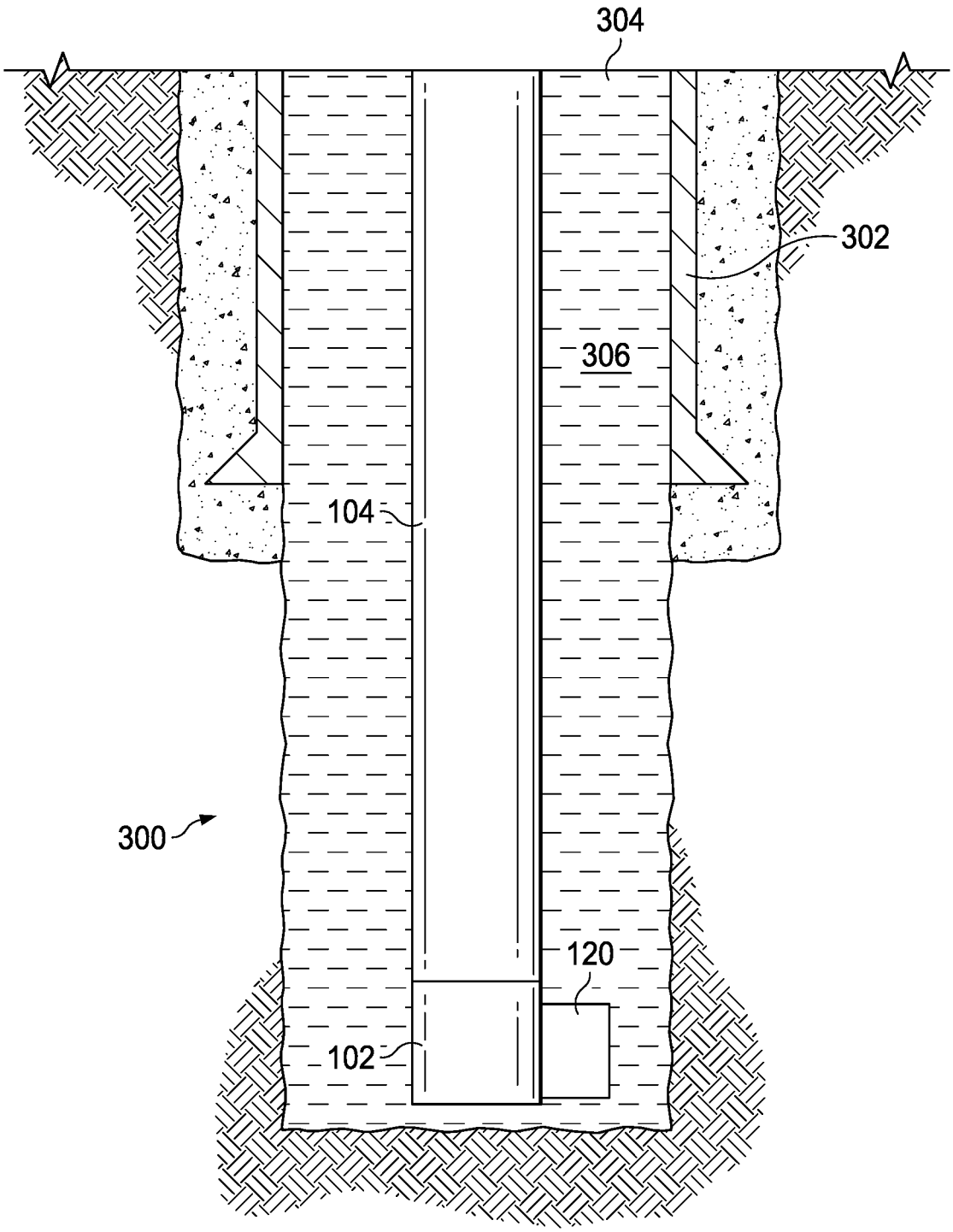
FIGS. 3A-3D are drawings of a deployment of a cable in a wellbore conduit in in accordance with an embodiment of the present disclosure.

At step 202, a wellbore assembly carries a cable spool cartridge (such as cable spool cartridge 120 from FIG. 1) into a wellbore such as wellbore 300 as shown in FIG. 3A. In the embodiment shown in FIGS. 3A-3D, the wellbore assembly is a tubular assembly, specifically, tubular assembly 101 including casing string 104 and casing shoe track 102 as described in reference to FIG. 1, and cable spool cartridge 120 is attached to the exterior of casing shoe track 102. In some embodiments, the cable spool cartridge may be attached to another suitable wellbore assembly such as a downhole tool (such as a packer) or a production tubing or work string. In some embodiments, the wellbore assembly to which the cable spool cartridge is attached is a non-tubular assembly.

In the embodiment of the present disclosure shown in FIG. 3A, cable spool cartridge 122 may contain a cable 122 (as illustrated in FIG. 1) that is a fiber optic cable; in some embodiments of the present disclosure, cable spool cartridge may contain an electrical cable or other suitable flexible cable spooled in the cartridge instead of or in addition to a fiber optic cable.

With casing string 104 lowered into the wellbore 300, a casing-casing annulus 304 is formed by the exterior surface of casing string 104 and the interior surface of outer casing 302. In FIG. 3A, casing string 104 has not yet been cemented in place, and drilling fluid 306 or another suitable displacement fluid fills casing-casing annulus 304.

At step 204 (FIG. 2), a fluid is flowed in the conduit containing the cable spool cartridge. In the embodiment shown in FIGS. 3A-3D, the fluid is a cement slurry 310 and the conduit is the casing-casing annulus 304. In some embodiments, the fluid can be drilling fluid or a displacement fluid flowed through the annulus prior to cementing.

Figure 3B:
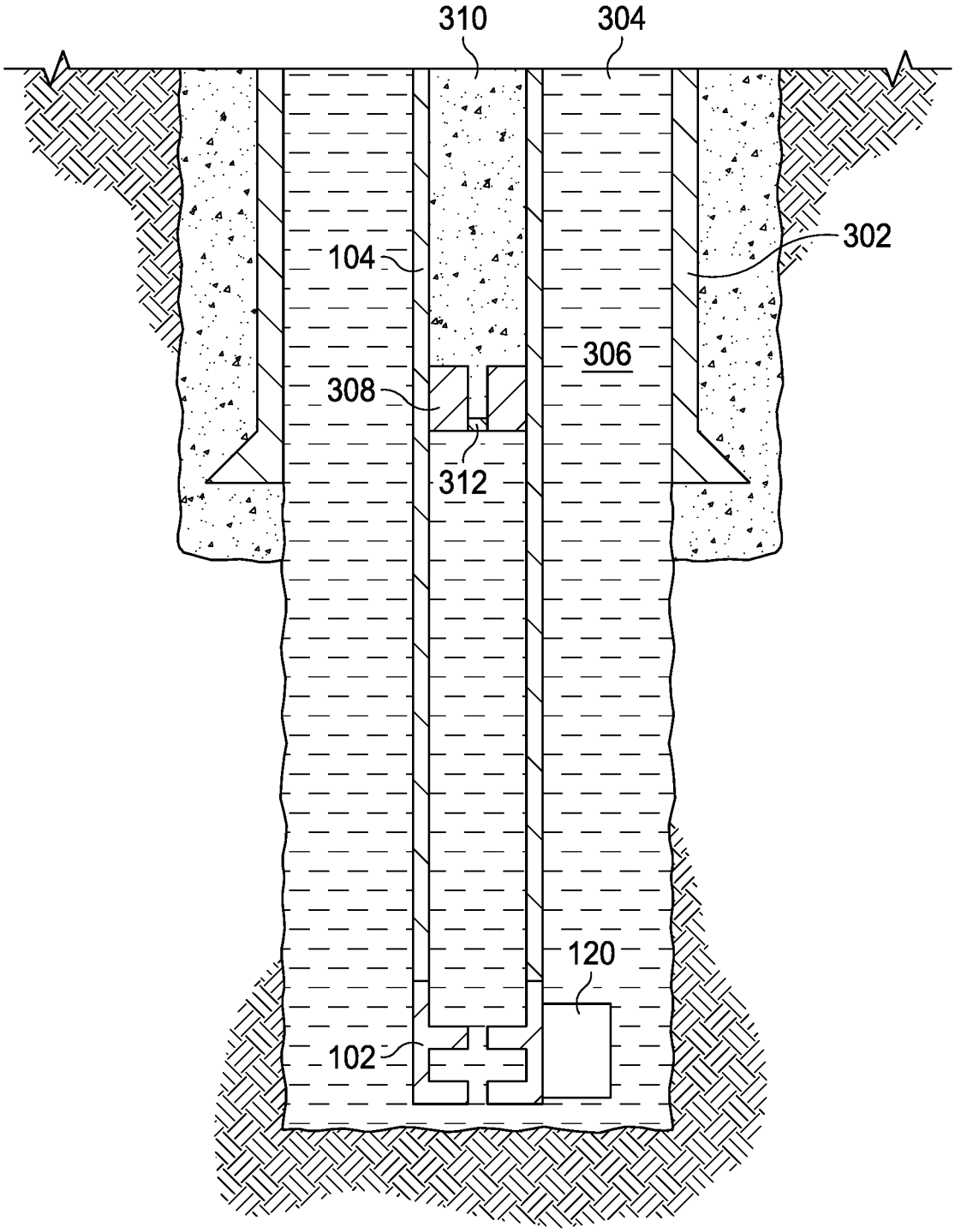
Figure 3C:
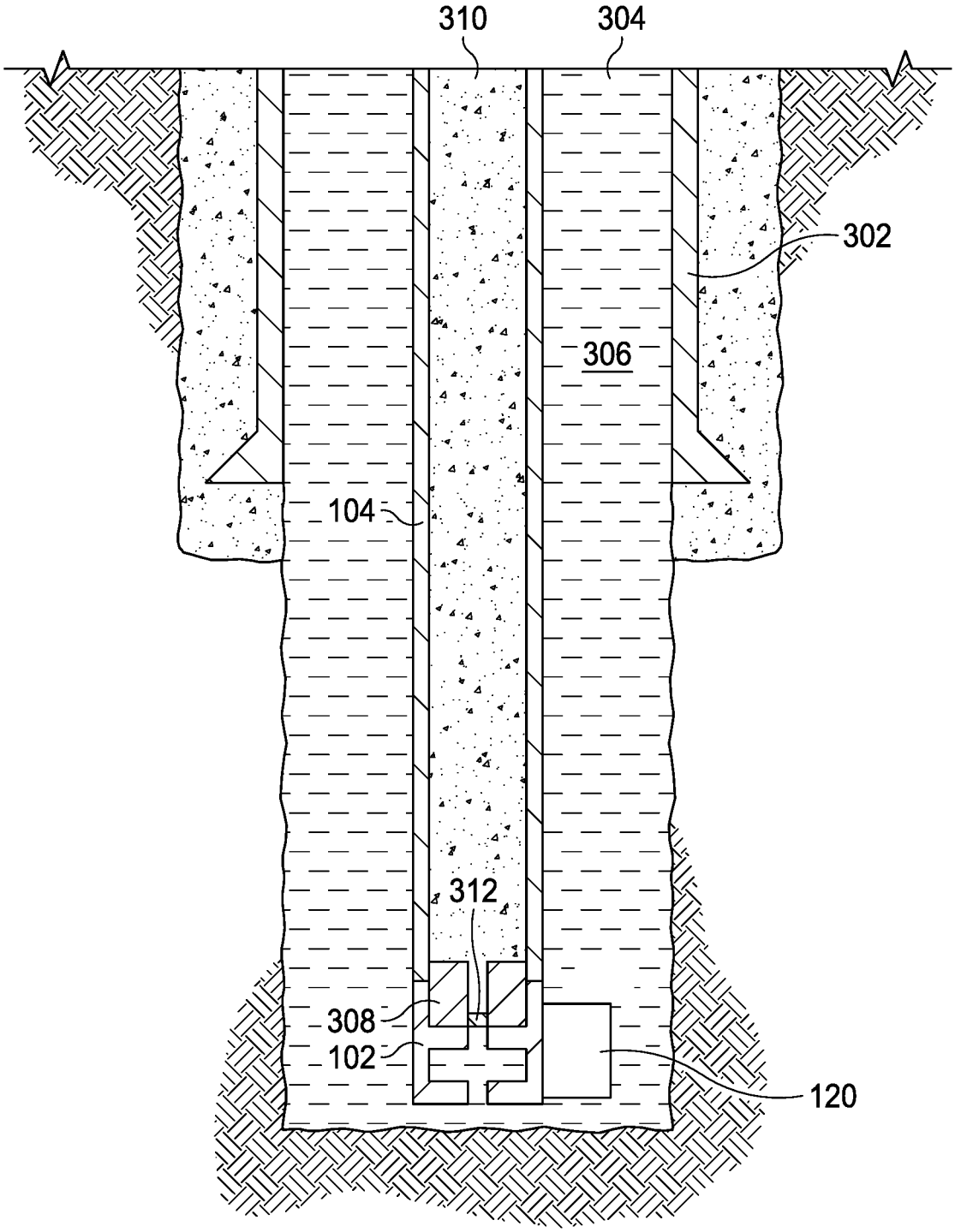

As shown in FIG. 3B, cement slurry 310 is first flowed in a downhole direction behind a plug 308 within the interior of tubular casing string 104 and through casing shoe track 102. As shown in FIG. 3C, plug 308 lands on the landing seat of casing shoe track 102. Plug 308 has a rupture disc 312 configured to rupture when a pressure at which cement slurry 310 exceeds a pre-determined amount. At FIG. 3D, as pressure continues to increase, rupture disc 312 ruptures, allowing cement slurry 310 to exit the downhole end of casing string 104 and fill casing-casing annulus 304.

At 206, the buoyancy device 124 is released and cable 122 is pulled into the conduit. In the embodiment shown in FIGS. 1 and 3A-3D, the release is triggered by the landing of plug 308 into landing seat 132. Specifically, in the illustrated embodiment, shear pins 136 connect landing seat 132 with buoyancy device 124. Shear pins 136 are configured to break at a lower pressure than that required to break rupture disc 312. As shown in FIG. 3C, plug 308 has landed on the landing seat of casing shoe track 102. The pressure at which cement slurry 310 is pumped is increased until shear pins 136 break. Breakage of shear pins 136 releases buoyancy device 124 from cartridge 120.

In some embodiments, buoyancy device 124 can be released from cable spool cartridge 120 by other or additional means. In some embodiments, cable spool cartridge 120 is configured to release buoyancy device 124 in response to casing shoe track 102 being pushed against the bottom of the well at a predetermined slack-off weight. In some embodiments, cable spool cartridge 120 is configured to release buoyancy device 124 in response to rotation of casing string 104 by a pre-determined number of rotations.

In some embodiments, an electronic control unit (ECU) can be attached to cable spool cartridge 120 and the ECU can be configured to release buoyancy device 124 in response to a detection of plug 308 arriving in casing shoe track 102 and/or landing in landing seat 132. The ECU can be connected to sensor(s) and can include a processor, a power source (such as a battery), and a release mechanism. Detection of plug 308 to trigger release by the ECU can be by one of several methods: In some embodiments, the seat of the plug has two un-connected metal sides, and the plug has a metal component such that landing of the plug closes an electrical circuit which provides a signal to the ECU, in response to which buoyancy device 124 is released. In some embodiments, landing seat 132 is equipped with a strain gauge that senses the pressure applied by plug 308 after landing, and the ECU is configured to release buoyancy device 124 when the strain reaches a predetermined amount. In some embodiments, the ECU is equipped with a sensor that detects plug 308 and is configured to release buoyancy device 124 when plug 308 arrives in proximity of the sensor, such as a magnetic sensor, sonar sensor, radio-frequency identification (RFID), or other suitable sensor. In some embodiments, the ECU is configured to receive a signal from the surface (such as a pressure signal) and thereby release buoyancy device 124 in response to receipt of the signal.

Figure 3D:
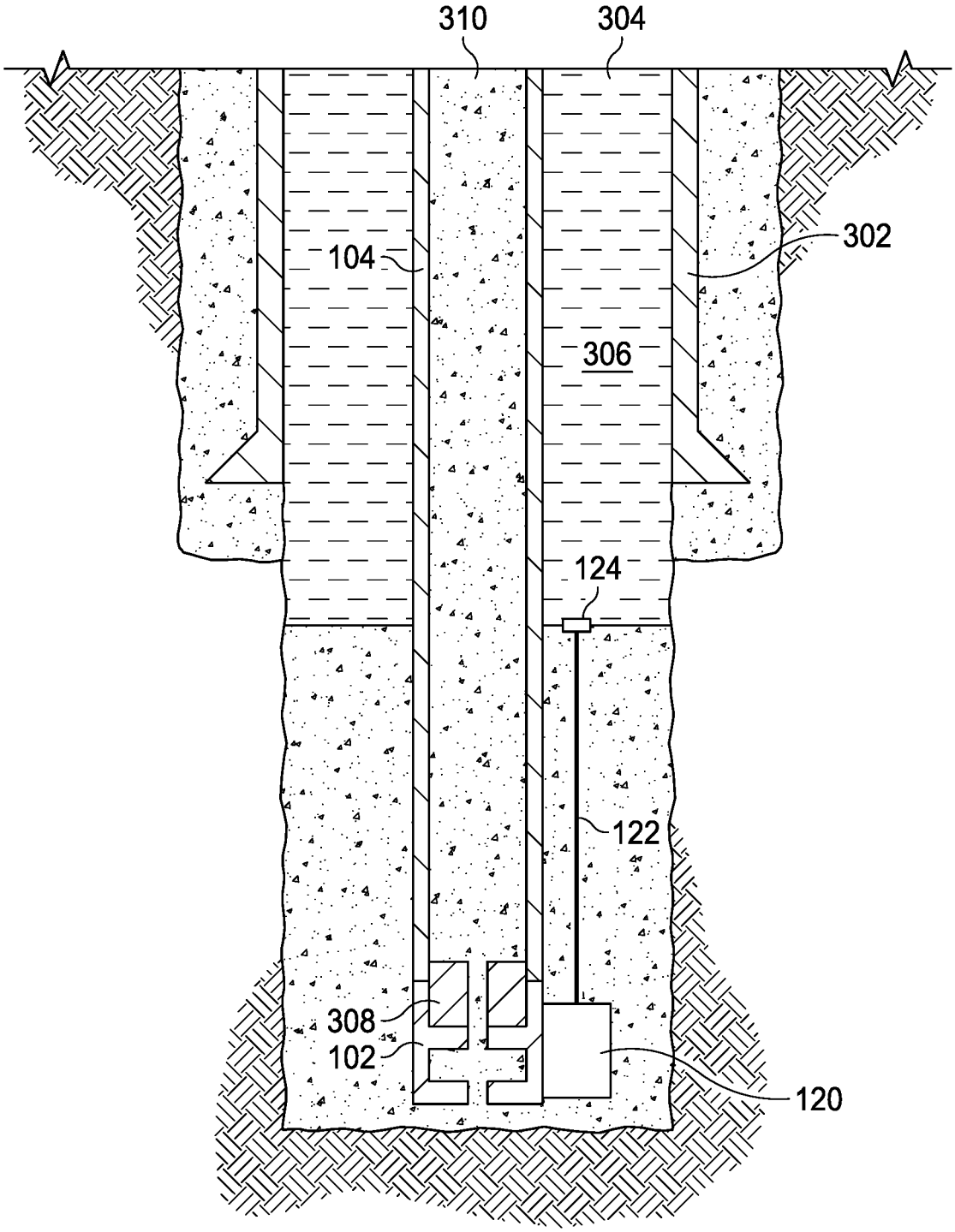

Buoyancy device 124 is configured to have a lower density than the cement in cement slurry 210. In the illustrated embodiment, as shown in FIG. 3D, as cement slurry 310 travels in an uphole direction past cartridge 120, buoyancy device 124 (which has been released from cartridge 120 as described above) tends to float in an upward direction along with the flow of cement slurry 310. As buoyancy device 124 floats in the uphole direction, the first end of cable 122 (attached to buoyancy device 124) is pulled out of cartridge 120 and into annulus 304. A second end of cable 122 remains attached to cartridge 120. In this way, as cement slurry 210 and buoyancy device 124 continue in an uphole direction and approach the surface, a length of cable 122 is deployed in the casing-casing annulus 304 for the full vertical distance (or a substantial portion of the vertical distance) from the cartridge 120 at the downhole end of casing string 104 up to a surface location (or proximate a surface location)

At step 208 (FIG. 2), upon reaching the surface or other final desired vertical location of the first (uphole) end of cable 122, the first end can be disconnected from buoyancy device 124 and attached to a surface unit such as a data acquisition unit, control unit, power unit, measurement unit, or other component which is disposed at the surface at the wellhead or at another suitable location. In some embodiments, cable 122 is a sensor cable such as a fiber optic cable and is attached to a data acquisition unit configured to transmit and/or receive a signal to or from the fiber optic cable, such that data can be collected and processed on the surface. In embodiments wherein the cable 122 is a fiber optic cable, the data acquisition unit can be a laser box configured to transmit and/or receive a light signal to or from fiber optic cable 122. The data acquisition unit can in some embodiments include a signal processing circuit and a reference fiber optic cable which receives a signal from a reference signal generator.

In some embodiments, cable 122 is a power cable and attached to a surface power source after disconnection from buoyancy device 124. In such embodiments where cable 122 is a power cable, cartridge 120 can include a connection to a downhole component such that power from the surface power source can be transmitted from the power source via cable 122 to the downhole component.

The system and method illustrated in FIGS. 1-3 can be used to deploy a fiber optic cable or other cable in a downhole conduit such as a casing-casing annulus. In one embodiment of the present disclosure, a fiber optic cable can be deployed in the casing-casing annulus before cementing with drilling fluid or other suitable fluid, such that subsequent cementing operations can be monitored. In such an embodiment, the deployed fiber optic cable can be used to, for example, measure the height of the cement slurry as it exits the casing shoe and advances towards the surface within the annulus. The higher density cement slurry can be detected as the untethered fiber optic cable will exhibit increased strain load along the portions of the annulus in which the cement is pumped. Through similar logic the position of lower density spacers pumped ahead of the cement as well as the displaced mud can also be derived.

In some embodiments, a fiber optic cable can be installed before or along with the cement slurry and can be used to detect the change in mechanical properties of the cement as the cement dehydrates and hardens. As the cement slurry gains compressive strength, this will be detected as the untethered fiber cable will exhibit increased strain load along the portions of the annulus in which the cement is hardening. This will allow the comparison of the planned cement properties to be compared to what is actually achieved during field application. The cement may not reach the designed properties due to several reasons, such as, for example, unexpected operational conditions that may lead to cement contamination, undiagnosed wellbore geometry considerations such as over-gauge hole, or lost circulation events during the cementing operation. Whatever the cause, detection of the failure of the cement to reach its desired mechanical properties (considered as a function of stress over time) can aid in diagnoses and the need for remediation can be considered. Wellbore integrity can therefore be improved as the well will only become increasingly hard to perform any remediation of the cement sheath once additional strings of casing and cement are added as the well is deepened. In some embodiments, installation of a temperature sensor will allow these properties to be examined with respect to the temperature gradient as calculated along the casing string from the casing shoe to surface.

Alternatively or in addition, a fiber optic cable installed in the casing-casing annulus using the system and method illustrated in FIGS. 1-3 can be used to measure strain or other properties throughout the life of the well, thus detecting pressure-induced events and/or any cracks or other failures in the cement sheath. Typically, cement slurries are designed to reach designed mechanical properties over the course of a few days, but the value of measuring the strain measured along the cemented fiber cable allows well integrity to be monitored for years, throughout the life of the well for detection of any degradation of the cement that may occur. By monitoring the stress along the cemented annuli, the pressure induced events that result in a change of the radial stress across the cement sheath can be monitored and any failure in the cement sheath can be detected. This can be beneficial for assessing any need for repair and continued operation of the wellbore throughout its producing life.

In some embodiments, the flexible cable deployed using the method and system described herein can be a cable other than a fiber optic cable, such as an electric cable, instead of or in addition to a fiber optic cable. For example, cracks or flaws in the cement sheath can be detected by configuring the cement to have piezoelectric properties or by adding carbon fibers to the cement, such that such cracks or flaws can be detected by an electric cable as a change in the electrical resistance of the cement.

Figure 4:
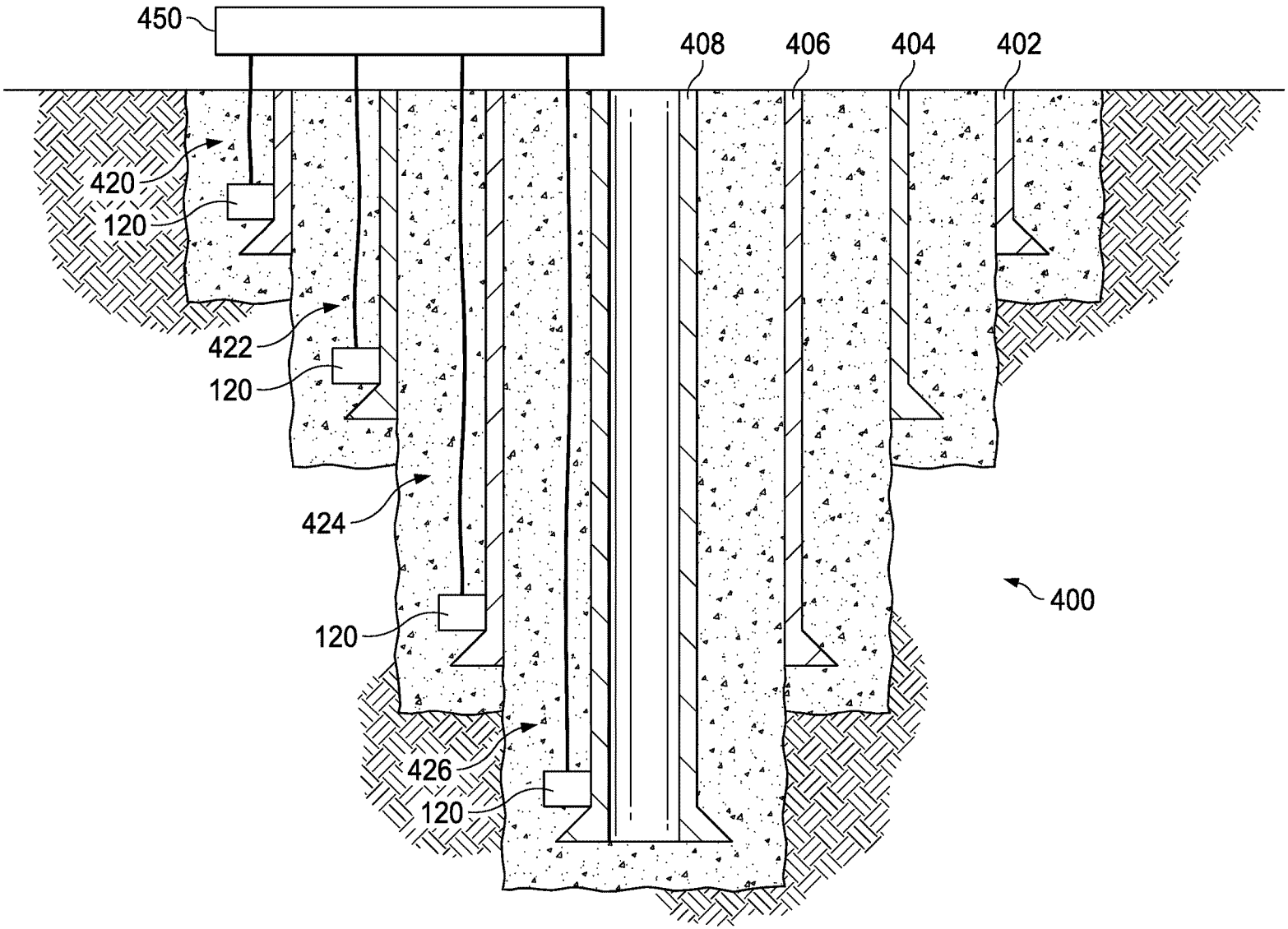
FIG. 4 is a drawing of a well system wherein cables are deployed in multiple casing-casing annuli in accordance with an embodiment of the present disclosure.

In some circumstances, a well may be drilled with multiple casing strings, such that a well may have multiple casing-casing annuli. In some embodiments of the present disclosure, cables can be deployed in each annulus of such a multi-casing system, to allow for monitoring and/or data transmission within each annulus, using the method and system illustrated in FIGS. 1-3 for each casing string in sequence. As shown in FIG. 4, multiple cable spool cartridges 120 may be used, with a cable spool cartridge 120 attached to the exterior of the downhole ends of each casing string as that casing string is lowered into the wellbore 400, and, using the method as described above with respect to FIGS. 1-3 with respect to each cartridge, a cable may be deployed within each annuli. As shown in FIG. 4, a first cable 420 is deployed in the annulus between the wellbore 400 and the first (outer) casing 402. A second cable 422 is deployed within the annulus between the first (outer) casing 402 and the second casing 404. A third cable 424 is deployed within the annulus between the second casing 404 and the third casing 406. A fourth cable 426 is deployed in the annulus between the third casing 406 and the fourth (inner) casing 408 (or production tubing).

In the illustrated embodiment, each of cables 420, 422, 424, and 426 are attached to a common data acquisition unit 450. In some embodiments, each of the cables from the different annuli may be attached to a different data acquisition unit. Data acquisition unit 450 can be disposed at the surface or at another suitable location.

Figure 5:
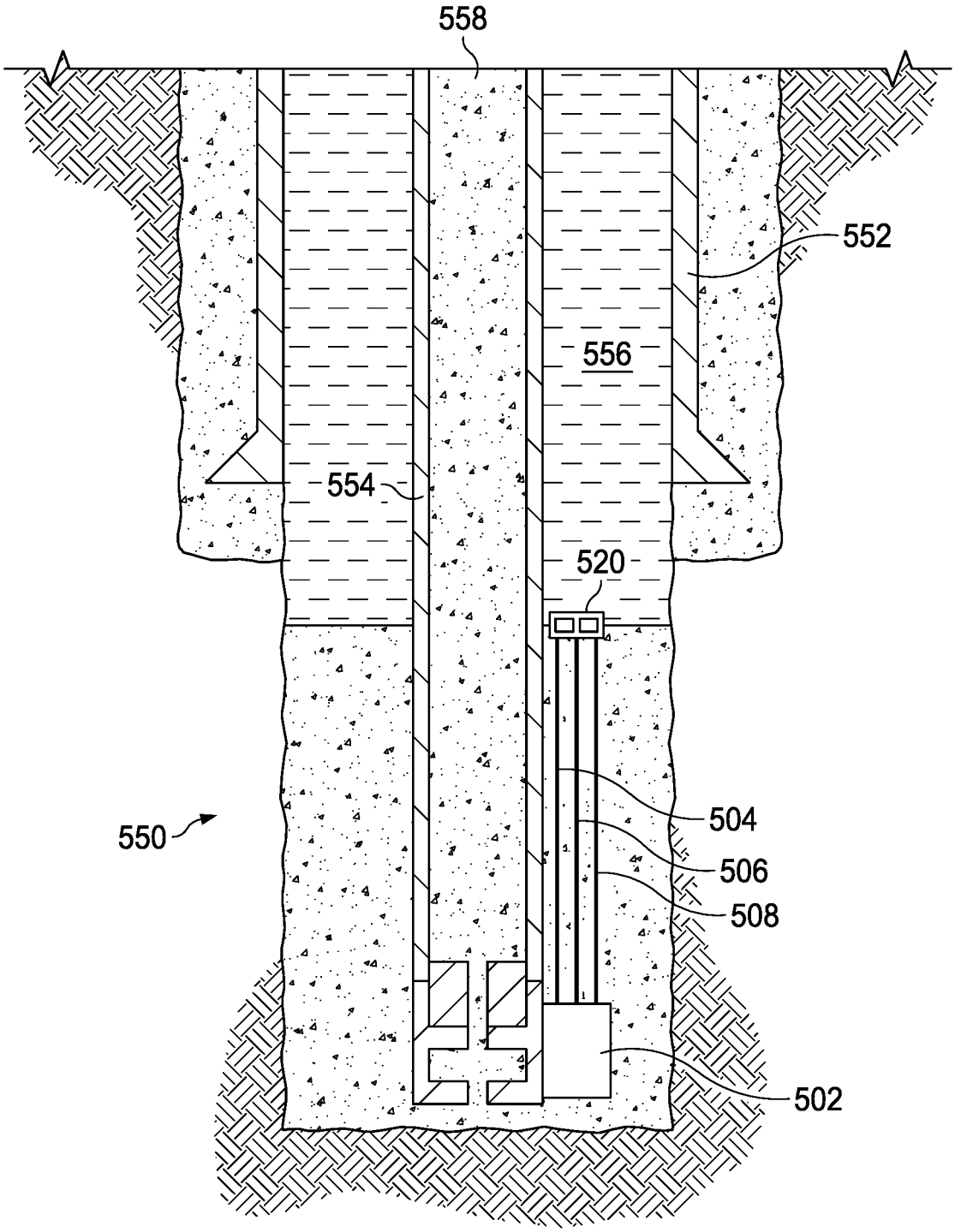
FIG. 5 is a drawing of an example triplet cable deployment system in accordance with an embodiment of the present disclosure.

FIG. 5 illustrates an example triplet cable deployment system in accordance with an embodiment of the present disclosure. In the embodiment shown in FIG. 5, cable spool cartridge 502 is configured to house three spools, each of which contains a flexible cable. A first spool contains a first cable 504, a second spool contains a second cable 506, and a third spool contains a third cable 508. Cables 504, 506, and 508 can in some embodiments comprise a fiber optic cable. One end of each of cables 504, 506, and 508 is attached to a buoyancy device 520, and the other end of each of cable 504, 506, and 508 is attached to the cable spool cartridge 502. Buoyancy device 520 is releasable attached to cable spool cartridge 502 in a manner as described in reference to one of the various embodiments as described in reference to FIGS. 3A-3D above. In other embodiments, a different cable spool cartridge 502 may be configured to house a different number of spools, such as four or five.

The embodiment shown in reference to FIG. 5 provides a system for deploying multiple (in the illustrated embodiment, three) cables within vertical length of a casing-casing annulus or other downhole conduit. Although three cables are illustrated in FIG. 5, in some embodiments another number (such as four or five) can be deployed by increasing the number of spools within cartridge 502. In some embodiments, the preferable number of cable may depend on the volume of the casing-casing annulus or other conduit into which the cables are to be deployed. Multiple cables equally spaced apart can ensure the whole cement sheath area, the space between the outer diameter of the casing and the wellbore wall, is covered for real-time distributed sensing. Multiple cables can provide redundancy and increase the probability of at least one cable reaching the surface. Another advantage of having multiple cables is the ability to interrogate multiple parameters. Small events in the cable are related to multiple parameters (such as temperature, pressure and acoustic energies) and it can be challenging to discriminate multiple parameters from one cable. While it is possible to provide simultaneous measurements of multiple parameters, there is an inherent trade-off between performance parameters such as sensing range, spatial resolution, and sensing resolution. Therefore, having dedicated cables for specific parameters can increase the accuracy of casing-casing annulus evaluation parameters.

Figure 6:
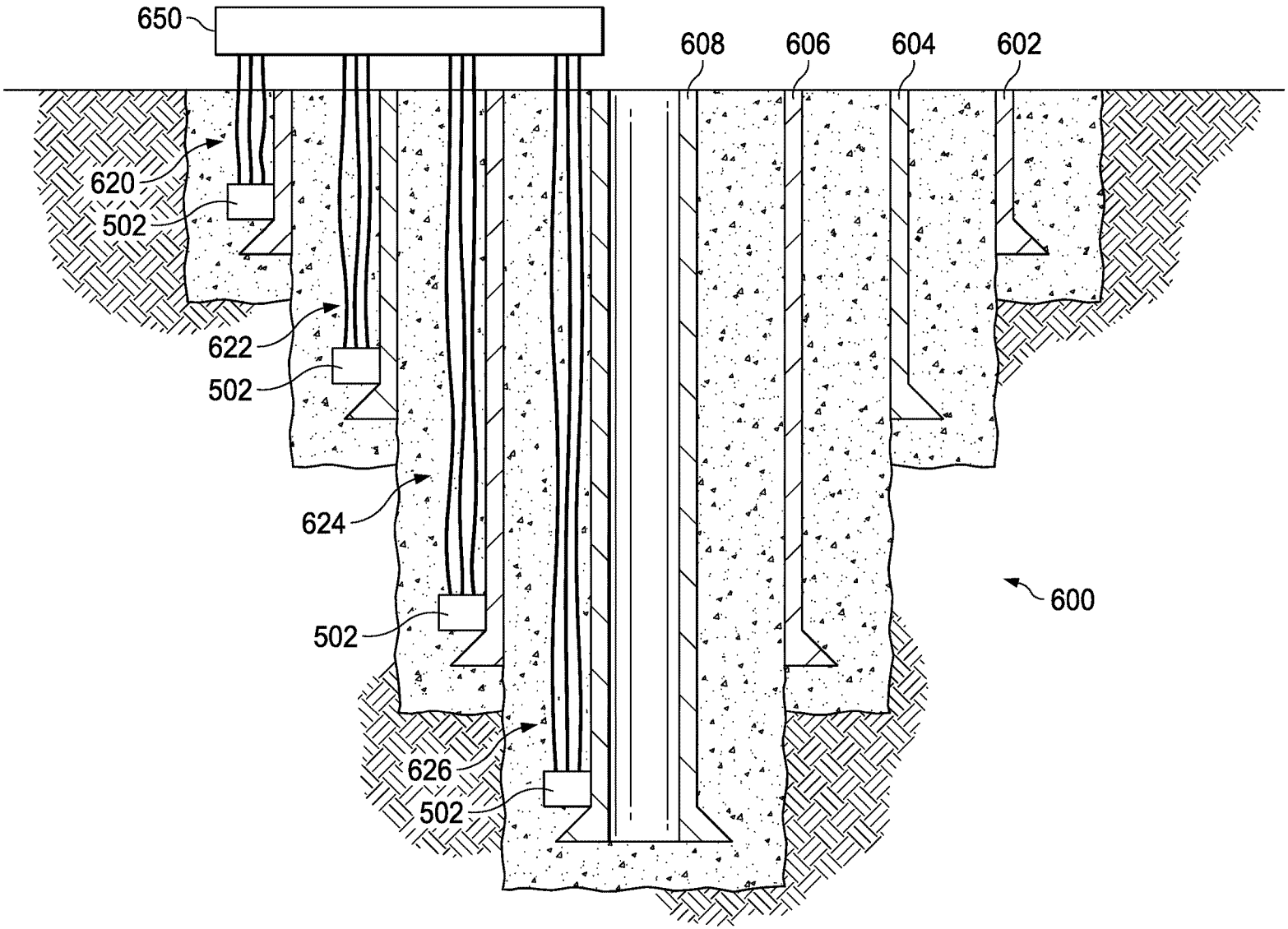
FIG. 6 is a drawing of a well system wherein multiple triplet cables are deployed in multiple casing-casing annuli in accordance with an embodiment of the present disclosure.

FIG. 6 is a drawing of a well system wherein multiple triplet cables are deployed in multiple casing-casing annuli in accordance with an embodiment of the present disclosure. As shown in FIG. 6, multiple triplet cable spool cartridges 502 may be used, with a triplet cable spool cartridge 502 attached to the exterior of the downhole ends of each casing string as that casing string is lowered into a wellbore 600, and, using the method as described above with respect to FIGS. 3A-3D and FIG. 5 with respect to each cartridge, a cable triplet may be deployed within each annuli as described in reference to FIG. 5. As shown in FIG. 6, a first cable triplet 620 is deployed in the annulus between wellbore 600 and the first (outer) casing 602. A second cable triplet 622 is deployed within the annulus between the first (outer) casing 602 and the second casing 604. A third cable triplet 624 is deployed within the annulus between the second casing 604 and the third casing 606. A fourth cable triplet 626 is deployed in the annulus between the third casing 606 and the fourth (inner) casing 608 (or production tubing).

In the illustrated embodiment, each of cable triplets 620, 622, 624, and 626 are attached to a common data acquisition unit 650. In some embodiments, each of the cables from the different annuli may be attached to a different data acquisition unit.

Figure 7:
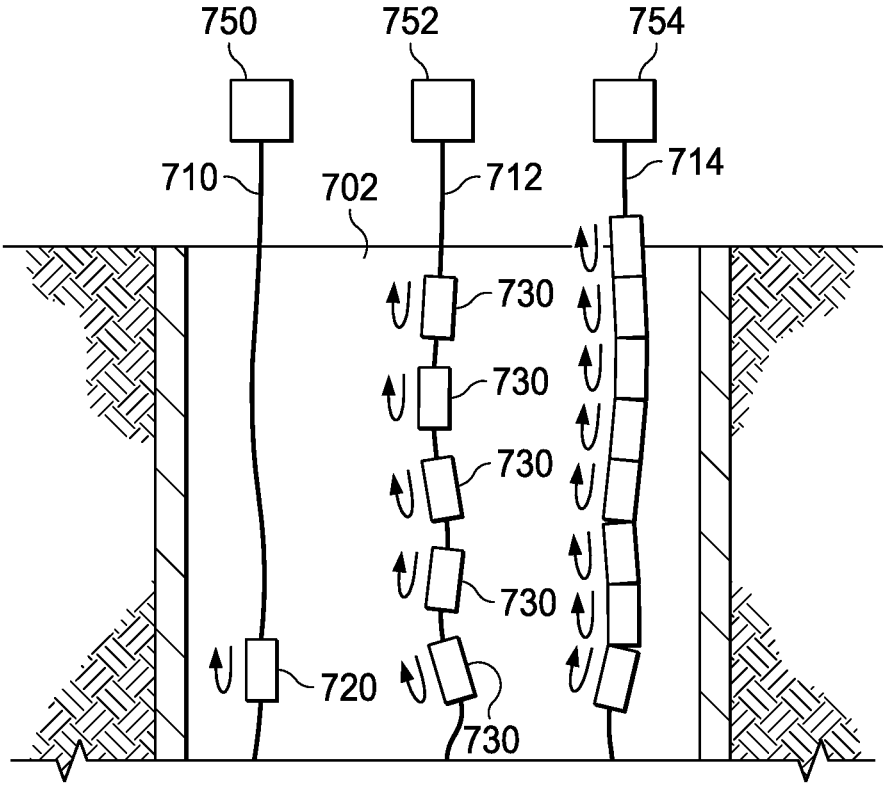
FIG. 7 is a drawing of a well system wherein each cable of a triplet cable set is connected to a separate data acquisition unit in accordance with an embodiment of the present disclosure.

FIG. 7 is a drawing of a well system wherein each cable of a triplet cable set is connected to a separate data acquisition unit in accordance with an embodiment of the present disclosure. The cables 710, 712, and 714 are components of a triplet of cables deployed in a casing-casing annulus 702 as described in reference to FIG. 5. Cable 710 is connected to first data acquisition unit 750. Cable 712 is connected to a second data acquisition unit 752. Cable 714 is connected to third data acquisition unit 754. Each cable and data acquisition unit can be configured to a single type or mode of sensor, or may each reflect a different type or mode of sensor. For example, in the illustrated embodiment, cable 710 attached to first data acquisition unit 750 can be a fiber optic cable connected to a single-point sensor 720. Cable 712 attached to second data acquisition unit 752 can be a fiber optic cable connected to multiple point sensors 730. Cable 714 attached to third data acquisition unit 754 can comprise a fiber optic cable as part of a distributed temperature sensing system. Data acquisition units 750, 752, and 754 can be disposed at the surface or at another suitable location.

As shown in FIG. 7, by easily and cost-effectively deploying multiple cables within the casing-casing annulus, the system can be readily configured for different sensing modes within a single annulus. Single point fiber optic sensing is an intrinsic or extrinsic measurement of a single sensor on an optical fiber. Single point strain sensing can be achieved by many mechanisms knowingly by an individual fiber Bragg grating (FBG), long period gratings (LPG) or Fabry-Perot and Mach-Zehnder systems. Single-point fiber sensors, even when multiplexed to form multi-point fiber sensors, may not intrinsically provide the wealth of information that can be provided through distributed optical fiber-based schemes that function along the entire fiber length. Distributed optical fiber sensors are generally based on Rayleigh, Brillouin, and Raman scattering, and use various demodulation schemes, including optical time-domain reflectometry, optical frequency-domain reflectometry, and related schemes. Local external perturbations along the sensing fiber (such as temperature and strain) can be detected by variations in amplitude, frequency, polarization, or phase of the backscattered sensing light. Each technique has its own advantages and disadvantages in terms of spatial resolution (which defines how close two events can be detected separately), sensitivity (which is measure of system SNR and/or a deciding factor for maximum measurable length), and sensing resolution (which is a measure of the smallest parameter change that can be recorded).

Figure 8A:
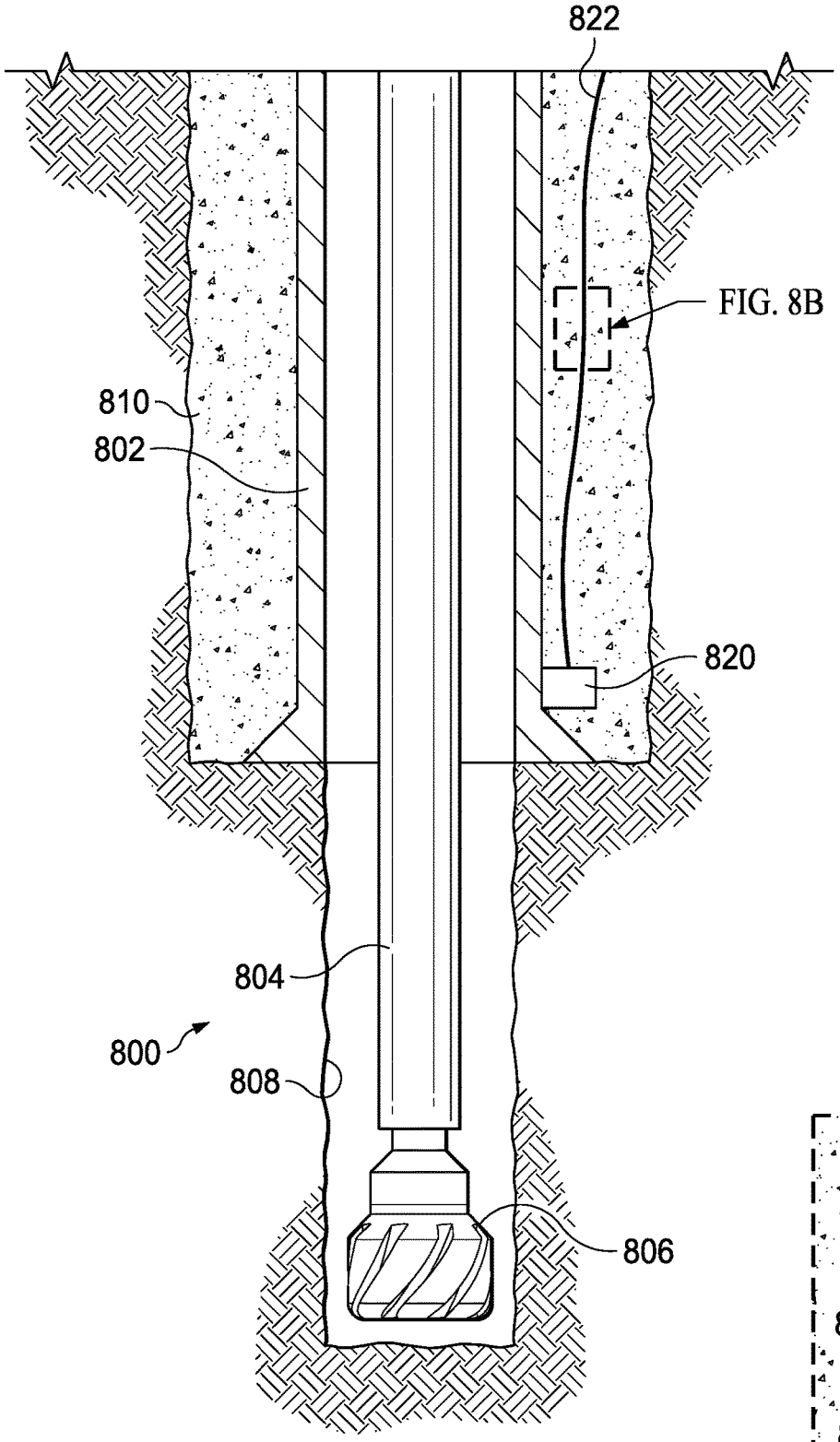
FIGS. 8A-8B are drawings of a fiber optic acoustic sensor system in accordance with an embodiment of the present disclosure.
Figure 8B:
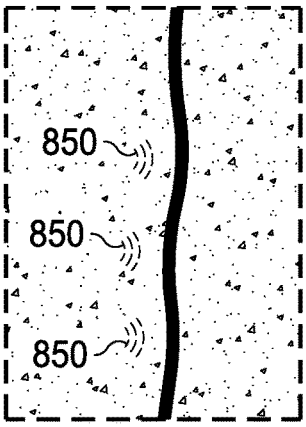

FIGS. 8A-8B are drawings of a fiber optic acoustic sensor system in accordance with an embodiment of the present disclosure. In the embodiment illustrated in FIG. 8A-8B, wellbore 800 is being drilled by drill bit 806 attached to the downhole end of drill string 804. As shown in FIG. 8A, casing 802 is installed in the uphole portion of wellbore 800 and cement 810 fills the annulus between the wellbore and casing 802. Fiber optic cable 822 is installed in the cement 810, using the methods described in reference to FIGS. 1 to 3A-3D above. Specifically, fiber optic cable 822 is deployed from cable spool cartridge 820 attached to the exterior of casing 802 and using buoyancy device (not shown) attached to the upper end of fiber optic cable 822.

In an embodiment of the present disclosure, fiber optic cable 822 deployed as shown in FIG. 8A can be used for vibration monitoring of drilling operations. In the illustrated embodiment, a pulse of light can be transmitted down fiber optic cable 822 by a data acquisition unit at the surface (not shown). As the light travels down the fiber, light reflections known as backscatter can be detected, which are caused by tiny strain events within the fiber which in turn are caused by localized energy from acoustic signals 850 (shown in FIG. 8B). This backscattered light travels back up the fiber optic cable 822 towards the data acquisition unit where it is sampled. The time synchronization of the laser pulse, reflecting the phase, frequency, and amplitude of acoustic signals 850, allows the backscatter event to be accurately mapped to a distance along fiber optic cable 822 (and therefore to a point along the vertical length of the annulus). Detection and analysis of acoustic signals 850 can be utilized to monitor the effect of drilling on the mechanical integrity of cement 810. In addition, when combined with drilling parameters, such detection and analysis can also be utilized for predicting geological formations and detecting downhole events and problems, such as mechanical or other failures of the bottom-hole-assembly or other portion of drill string 804.

What is claimed is:

1. A method of deploying flexible cables in a wellbore, the method comprising:

carrying, by a first tubular assembly, a first cable spool cartridge into the wellbore, the first cable spool cartridge attached to an exterior of the first tubular assembly and containing a first flexible cable, wherein a first end of the first flexible cable is attached to a first buoyancy device, and wherein the first buoyancy device is releasably attached to the first cable spool cartridge, and wherein a first annulus is at least partially defined by the exterior of the first tubular assembly;

flowing a first fluid into the first annulus, the first fluid having a greater density than the first buoyancy device;

releasing, by the first cable spool cartridge, the first buoyancy device, wherein the first buoyancy device is configured to travel after release in the uphole direction and thereby pull the first flexible cable from the cable spool cartridge and into the first annulus;

disposing a second tubular assembly within the first tubular assembly, wherein a second cable spool cartridge containing a second flexible cable is attached to an exterior of the second tubular assembly, wherein a first end of the second flexible cable is attached to a second buoyancy device, and wherein the second buoyancy device is releasably attached to the second cable spool cartridge, and wherein a second annulus is at least partially defined by the exterior of the second tubular assembly, flowing a second fluid into the second annulus, the second fluid having a greater density than the second buoyancy device;

releasing, by the second cable spool cartridge, the second buoyancy device, wherein the second buoyancy device is configured to travel after release in the uphole direction with the fluid and thereby pull the first flexible cable from the cable spool cartridge and into the second annulus; and attaching the first end of the first flexible cable and the first end of the second flexible cable to a data acquisition unit.

2. The method of claim 1, wherein the first flexible cable comprises a fiber optic cable, wherein the method further comprises transmitting a light signal through the fiber optic cable.

3. The method of claim 1, wherein the first fluid and the second fluid comprise cement slurries, and wherein the method further comprises detecting a position of the cement slurry in the first annulus based on a signal from the first flexible cable and detecting a position of the cement slurry in the second annulus based on a signal from the second flexible cable.

4. The method of claim 1, further comprising detecting a change in a mechanical property of cement in the first annulus based on a signal from the first flexible cable.

5. The method of claim 4, wherein the mechanical property is a strain load.

6. The method of claim 1, wherein the first flexible cable comprises an electric cable, and wherein the method further comprises detecting a change in an electrical resistance of cement in the first annulus.

7. The method of claim 1, wherein the first cable spool cartridge comprises a plurality of flexible cables, each of the plurality of flexible cables having a respective first end, wherein each respective first end of the plurality of flexible cables is attached to the first buoyancy device.

8. The method of claim 1, wherein the first flexible cable comprises a power cable.

9. A method of deploying flexible cables in a wellbore, the method comprising:

carrying, by a second casing disposed in first casing disposed in the wellbore, a first cable spool cartridge into the wellbore, the first cable spool cartridge attached to an exterior of the second casing and containing a first flexible cable, wherein a first end of the first flexible cable is attached to a first buoyancy device, and wherein the buoyancy device is releasably attached to the first cable spool cartridge;

flowing a first fluid in a downhole direction through an interior of the second casing and in an uphole direction within an annulus at least partially defined by the exterior of the second casing, the first fluid having a greater density than the first buoyancy device;

releasing, by the first cable spool cartridge, the first buoyancy device, wherein the buoyancy device is configured to travel after release in the uphole direction with the first fluid and thereby pull the first flexible cable from the cable spool cartridge and into the first annulus;

attaching a second cable spool cartridge to an exterior of a third casing, the second cable spool cartridge containing a second flexible cable, a first end of the second flexible cable attached to a second buoyancy device releasably attached to the second cable spool cartridge;

lowering the third casing into the wellbore within the second casing, the second cable spool cartridge positioned proximate to the downhole end of the third casing within a second annulus defined by the interior of the second casing and the exterior of the third casing;

flowing a second fluid in an uphole direction in the second annulus, the second fluid having a greater density than the second buoyancy device;

releasing the second buoyancy device from the second cable spool cartridge, thereby allowing the first end of the second flexible cable to travel in an uphole direction with the second fluid and thereby pull the second flexible cable from the second cable spool cartridge and into the second annulus; and attaching the first end of the first flexible cable and the first end of the second flexible cable to a data acquisition unit.

10. A downhole deployment system for flexible cables, the system comprising:

a first cable spool cartridge attached to an exterior of a first tubular assembly disposed in a wellbore, the first cable spool cartridge containing a first flexible cable;

a first buoyancy device releasably attached to a first end of the first flexible cable and releasably attached to the first cable spool cartridge, wherein the first buoyancy device is configured to be released from the first cable spool cartridge to travel in an upwards direction within a first annulus at least partially defined by the exterior of the first tubular assembly at least partially filled with a fluid having a higher density than the first buoyancy device, such that, upon release, the first flexible cable is pulled from the cable spool cartridge and into the first annulus;

a second cable spool cartridge attached to an exterior of a second tubular assembly disposed in the wellbore within the first tubular assembly, the second cable spool cartridge containing a second flexible cable;

a second buoyancy device releasably attached to a first end of the second flexible cable and releasably attached to the second cable spool cartridge, wherein the second buoyancy device is configured to be released from the second cable spool cartridge to travel in an upwards direction within a second annulus at least partially defined by the exterior of the second tubular assembly at least partially filled with a second fluid having a higher density than the second buoyancy device, such that, upon release, the second flexible cable is pulled from the second cable spool cartridge and into the second annulus; and a data acquisition unit, wherein the system is configured such that, after release of the first flexible cable and of the second flexible cable into the first annulus and the second annulus, respectively, the first end of the first flexible cable and the first end of the second flexible cable can be connected to the data acquisition unit.

11. The downhole deployment system of claim 10, wherein the first flexible cable comprises a fiber optic cable.

12. The downhole deployment system of claim 10, wherein the first flexible cable comprises an electric cable.

13. The downhole deployment system of claim 12, wherein the first fluid and the second fluid comprise cement slurries.

14. The downhole deployment system of claim 12, further comprising a shear pin configured to release the first buoyancy device in response to a plug landing in a plug seat.

15. The downhole deployment system of claim 12, further comprising an electronic control unit configured to release the first buoyancy device in response to one of:

a signal from a circuit closing in response to pumpable plug landing in a downhole plug seat;

a signal generated by a sensor configured to sense an arrival of a pumpable plug at a downhole location; and a signal from an operator.

16. The downhole deployment system of claim 10, wherein the data acquisition unit comprises a laser box.

17. The downhole deployment system of claim 10, wherein the first flexible cable comprises a power cable.

* * * * *